US005706782A

United States Patent [19]

Kurihara

[11] Patent Number: 5,706,782

[45] Date of Patent: Jan. 13, 1998

[54] ENGINE CONTROL SYSTEM

[75] Inventor: Masaru Kurihara, Musashino, Japan

[73] Assignee: Fuji Jukogyo Kabushiki Kaisha, Tokyo, Japan

[21] Appl. No.: 810,365

[22] Filed: Mar. 3, 1997

[30] Foreign Application Priority Data

Mar. 1, 1996 [JP] Japan ..... 8-045220

[51] Int. Cl.[6] ..... F02D 7/00

[52] U.S. Cl. ..... 123/399

[58] Field of Search ..... 123/399

[56] References Cited

U.S. PATENT DOCUMENTS

| | | | |
|---|---|---|---|
| 5,551,396 | 9/1996 | Suzuki et al. | 123/399 |
| 5,553,581 | 9/1996 | Hirabayashi et al. | 123/399 |
| 5,562,080 | 10/1996 | Nishihara et al. | 123/399 |
| 5,619,967 | 4/1997 | Streib | 123/399 |

*Primary Examiner*—Raymond A. Nelli
*Attorney, Agent, or Firm*—Beveridge, DeGrandi, Weilacher & Young, LLP

[57] ABSTRACT

An engine control apparatus controls a throttle valve opening degree in response to a demand output of a driver. A target charged intake air amount of air taken into a cylinder per intake stroke is set in response to the demand output. Based on an air pressure generated at an upstream side of a throttle valve, the maximum actual charged intake air amount is set as a maximum value of the actual charged intake air amount taken into the cylinder per intake stroke. The target charged intake air amount is normalized by calculating a ratio of the target charged intake air amount to the maximum actual intake air amount. The throttle valve opening degree is set based on the normalized target charged intake air amount and an engine speed. Then, a signal for actuating the throttle valve is output to a throttle actuator so that the throttle valve has the set opening degree. Fuel injection amount is set based on the target charged intake air amount.

24 Claims, 20 Drawing Sheets

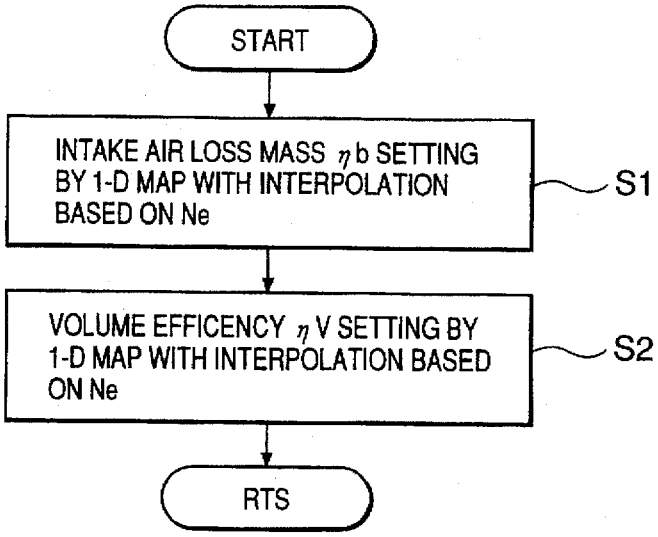
FIG.11
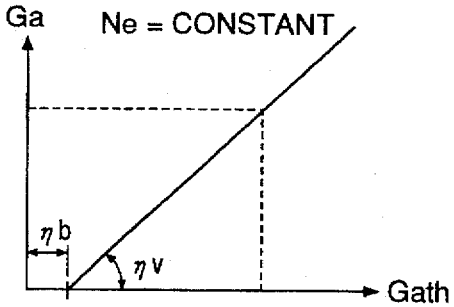
FIG.12
| Ne (rpm) | 750 | 1000 | 2000 | 3000 | 4000 | 5000 | 6000 | 7000 |
|---|---|---|---|---|---|---|---|---|
| ηv (%) | 85 | 86 | 93 | 94 | 90 | 102 | 91 | 90 |
| ηb (mg) | 45 | 50 | 50 | 50 | 65 | 40 | 55 | 55 |
FIG.13

ENGINE CONTROL SYSTEM

BACKGROUND OF THE INVENTION

The present invention relates to an engine control system that adjusts a throttle valve opening degree in response to a demand output of a driver, such as an accelerator pedalling amount, to supply an intake air to a cylinder, the intake air amount being matched the demand output.

There are a variety of techniques proposed recently for improving response to a driver's demand output and drivability by electronically controlling a throttle valve opening degree.

For example, SAE paper 780346 (1978) and Japanese Patent No. 3 (1991)-63654 disclose a technique that primarily controls fuel (or controls fuel and air simultaneously). In the technique, an accelerator pedalling amount is detected as a driver's demand output. A fuel injection amount is set in response to the accelerator pedalling amount. A target intake air amount is set for obtaining a desired fuel and air ratio based on the fuel injection amount, an engine speed and an engine temperature, etc. A throttle valve opening degree is thus set using the target intake air amount. An amount of air that passes through the throttle valve depends on the throttle valve opening degree.

In the conventional technique, the throttle valve passing air amount is indirectly detected based on an intake air amount detected by an intake air amount sensor. The sensor is provided at an upstream side of the throttle valve. A feedback control is executed to the throttle valve opening degree so that the detected intake air amount becomes the target intake air amount.

Further, Japanese Patent No. 5 (1993)-65845 discloses another technique. In this case, a throttle valve passing air amount is calculated based on a throttle valve opening degree and an air pressure of an intake port provided at a downstream side of the throttle valve. The throttle valve opening degree is controlled based on the throttle valve passing air amount.

These conventional techniques employ an intake air amount and a throttle valve passing air amount (basic amounts) as parameters for controlling a throttle opening degree. However, the air amount supplied at the maximum horse power or the rapid acceleration is more than 100 times as much as the air amount supplied at the engine start or idling. A dynamic range thus becomes more than 10,000 times for 1/100 accuracy.

This results in a computer of high speed and large capacity being required for accurately setting the throttle valve opening degree being matched the air amounts. However, a conventional computer employed in engine control has to bear a heavy calculation load for this purpose.

Further, there is a technique to accurately set a throttle opening degree by referring to a map based on the intake air amount or throttle valve passing air amount. However, the air amount as a parameter is of very wide dynamic range so that a lot of data is required for the map. This results in a memory of large capacity being required.

SUMMARY OF THE INVENTION

A purpose of the invention is to provide an engine control apparatus that can accurately set a throttle valve opening degree corresponding to a target intake air amount and attains accurate controllability even with a conventional computer without using an intake air amount of wide dynamic range as a variable to have a low heavy load.

The present invention provides a control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising: means, responsive to the demand output, for setting a target charged intake air amount of air taken into the cylinder per intake stroke; means, based on an air pressure generated at an upstream side of the throttle valve, for setting the maximum actual charged intake air amount as the maximum value of an actual charged intake air amount taken into the cylinder per intake stroke; means for normalizing the target charged intake air amount by calculating a ratio of the target charged intake air amount to the maximum actual intake air amount; means for setting the throttle valve opening degree based on the normalized target charged intake air amount and an engine speed; and means for outputting a signal for actuating the throttle valve to the throttle actuator so that the throttle valve has the opening degree set by the throttle valve opening degree setting means.

The present invention further provides a control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising: means, responsive to the demand output, for setting a target charged intake air amount of air taken into the cylinder per intake stroke; means, based on an intake port air pressure generated at a downstream side of the throttle valve, for setting an actual charged intake air amount taken into the cylinder per intake stroke; means, responsive at least to the target and actual charged intake air amounts, for calculating, using a reverse chamber model, a throttle valve opening degree required for equalizing the target charged intake air amount and a charged intake air amount taken into the cylinder after an elapse of a minute period; and means for outputting a signal for actuating the throttle valve to the throttle actuator so that the throttle valve has the calculated opening degree.

The present invention further provides a control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising: means, responsive to the demand output, for setting a target charged intake air amount of air taken into the cylinder per intake stroke; means, based on an air pressure generated at a downstream side of the throttle valve, for setting an actual charged intake air amount taken into the cylinder per intake stroke; means, based on an air pressure generated at an upstream side of the throttle valve, for setting the maximum charged intake air amount as the maximum value of an actual charged intake air amount taken into the cylinder per intake stroke; means for setting the throttle valve opening degree based on an intake air ratio and an engine speed indicating value, the intake air ratio being a ratio of a mean value of the target charged intake air amount and the actual charged intake air amount to the maximum charged intake air amount, the engine speed indicating value being calculated by adding an engine speed and an increment or a decrement of the engine speed based on the target charged intake air amount and the actual charged intake air amount; and means for outputting a signal for actuating the throttle valve to the throttle actuator so that the throttle valve has the opening degree set by the throttle valve opening degree setting means.

BRIEF DESCRIPTION OF DRAWINGS

FIG. 11 is a flow chart of an intake air loss mass and volume efficiency setting routine;

FIG. 12 is a graph showing a relationship between a charged intake air amount and a theoretical charged intake air amount;

FIG. 13 is an explanatory view of one dimensional map for intake air loss mass and volume efficiency setting;

DETAILED DESCRIPTION OF THE PREFERRED EMBODIMENTS

An embodiment of the present invention will be described with reference to the drawings.

Figure 1:
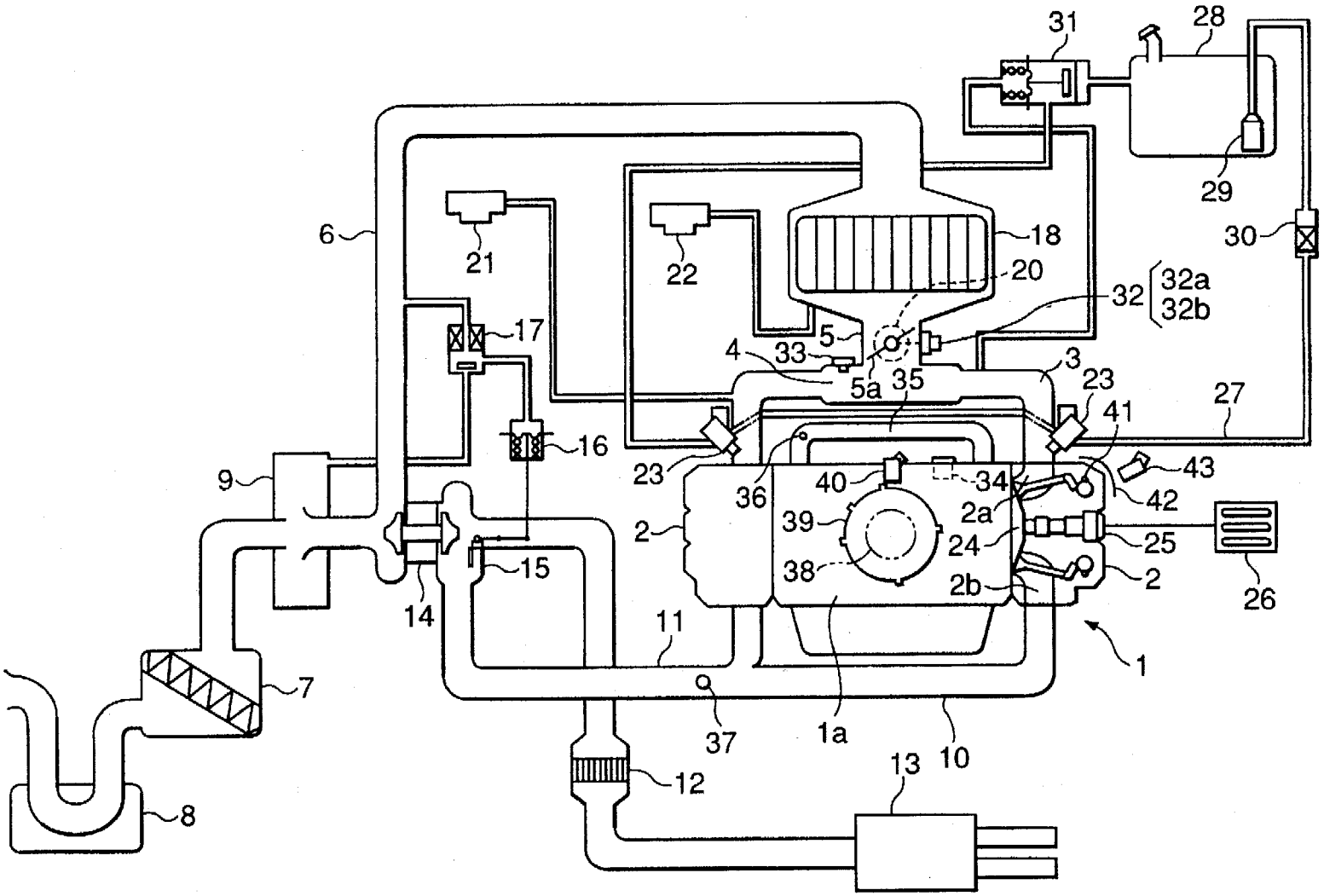
FIG. 1 is a view showing an overall configuration of an engine.

An overall configuration of an engine is described with reference to FIG. 1. Shown in FIG. 1 is a horizontally opposed four-cylinder engine 1. An intake manifold 3 is connected to each intake port 2*a* of a cylinder head 2 of the engine 1. A throttle chamber 5 is connected to the intake manifold 3 via an air chamber 4 to which intake passages of cylinders are connected. At an upstream side of the throttle chamber 5, an air cleaner 7 is connected to an intake pipe 6. The air cleaner 7 is also connected to an intake chamber 8 for taking air. The intake pipe 6 is provided with a resonator chamber 9 at its downstream side closer to the air cleaner 7. An exhaust manifold 10 is connected to an exhaust port 2*b* of the cylinder head 2. An exhaust pipe 11 is further connected to the exhaust manifold 10 and is provided with a catalyst converter 12 connected to a muffler 13.

The engine 1 is further provided with a turbocharger 14. The intake pipe 6 is provided with a compressor not shown at the downstream side of the resonator chamber 9. And, the exhaust pipe 11 is provided with a turbine not shown. A waste gate valve 15 is provided at an intake opening of a turbine housing of the turbocharger 14. An actuator 16 is provided so as to actuate the waste gate valve 15. The actuator 16 has two rooms separated by a diaphragm. One of the rooms is a pressure chamber connected to a duty solenoid valve 17 for controlling the waste gate valve 15. The other room houses a spring so as to close the waste gate valve 15.

The duty solenoid valve 17 is provided at a passage that connects the resonator chamber 9 and the intake pipe 6 at the turbocharger's compressor side. The duty solenoid valve 17 adjusts air pressures at the resonator chamber and compressor sides to supply air of the adjusted pressure to the pressure chamber of the actuator 16. This duty solenoid valve's operation executes in response to a duty ratio of a control signal from an electric control unit (ECU) 50 shown in FIG. 5 that will be described later. The waste gate valve 15 is thus controlled by the ECU 50 to adjust an exhaust gas relief by the waste gate valve 15 to control a supercharged pressure generated by the turbocharger 14.

Figure 2:
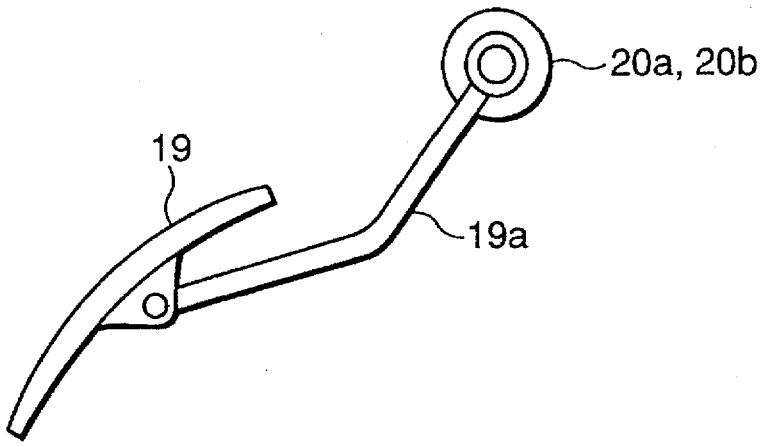
FIG. 2 is a side view showing an accelerator pedal.

An inter cooler 18 is provided at the intake pipe 6 just above the throttle chamber 5 having a throttle valve 5*a*. The throttle valve 5*a* is not mechanically connected to an accelerator pedal 19 shown in FIG. 2. A throttle actuator 20, such as an electric motor and a hydraulic motor, controls a throttle opening degree of the throttle valve 5*a* to regulate an intake amount of air passing therethrough. In FIG. 2, the accelerator pedal 19 is supported by an accelerator lever 19*a* provided with a first and a second accelerator opening degree sensor 20*a* and 20*b*, such as potentiometers. The sensors 20*a* and 20*b* supply values to the ECU 50, the values corresponding to a pedalling amount θacc of the accelerator pedal 19 as the demand output from a driver. Based on the value detected by the first sensor 20*a*, the ECU 50 determines the pedalling amount θacc. Further, the ECU 50 compares the output values of the sensors 20*a* and 20*b* to determine whether the values are equal to each other to diagnose the first sensor 20*a*.

An intake air pressure sensor 21 is connected to the intake manifold 3. The sensor 21 detects an intake air (absolute) pressure P1 at the downstream side of the throttle valve 5*a*. Further, a pre-throttle pressure sensor 22 is provided at the downstream side of the inter cooler 18. The sensor 22 detects a pre-throttle (absolute) pressure P2 corresponding to an intake air pressure at the upstream side of the throttle Valve 5*a*.

An injector 23 is provided above the intake port 2*a* of each cylinder of the intake manifold 3. The cylinder head 2 is provided with an ignition plug 24 per cylinder, with a tip extending into a combustion chamber. An ignitor 26 is connected to the ignition plugs 24 via an ignition coil 25 provided per cylinder.

The injector 23 is connected to a fuel tank 28 through a fuel supply passage 27. Installed in the fuel tank 28 is an in-tank type fuel pump 29. Fuel is fed by the fuel pump 29 to the injector 23 and a pressure regulator 31 via a fuel filter 30 provided along the fuel supply passage 27. The pressure regulator 31 regulates fuel pressure and feeds back the fuel to the fuel tank 28 so that pressure-regulated fuel is supplied to the injector 23.

The throttle valve 5*a* is provided with a throttle sensor 32. Installed in the sensor 32 are a throttle opening degree sensor 32*a* and an idle switch 32*b*. The sensor 32*a* outputs a voltage corresponding to a throttle opening degree. The switch 32*b* turns on when the throttle valve 5*a* is completely closed. The air chamber 4 is provided with an intake air temperature sensor 33. A cylinder block 1*a* of the engine 1 is provided with a knocking sensor 34. A coolant temperature sensor 36 is provided at a coolant passage 35 connecting left and right banks of the cylinder block 1*a*. The exhaust manifold 10 is provided with an $O_2$ sensor 37 that detects oxygen density in an exhaust gas.

A crank rotor 39 is axially connected to a crank shaft 38 supported by the cylinder block 1*a*. A crank angle sensor 40 is provided so as to face an outer periphery of the crank rotor 39. The sensor 40 has an electromagnetic pickup or the like to detect protrusions of the crank rotor 39 each corresponding to a crank angle. A cam shaft 41 is provided that rotates ½ to one rotation of the crank shaft 38. A cam rotor 42 is provided around the cam shaft 41. Further, a cam angle sensor 43 is provided so as to face the rotor 42. The sensor 43 has an electromagnetic pickup or the like to determine a cylinder at the present combustion stroke.

Figure 3:
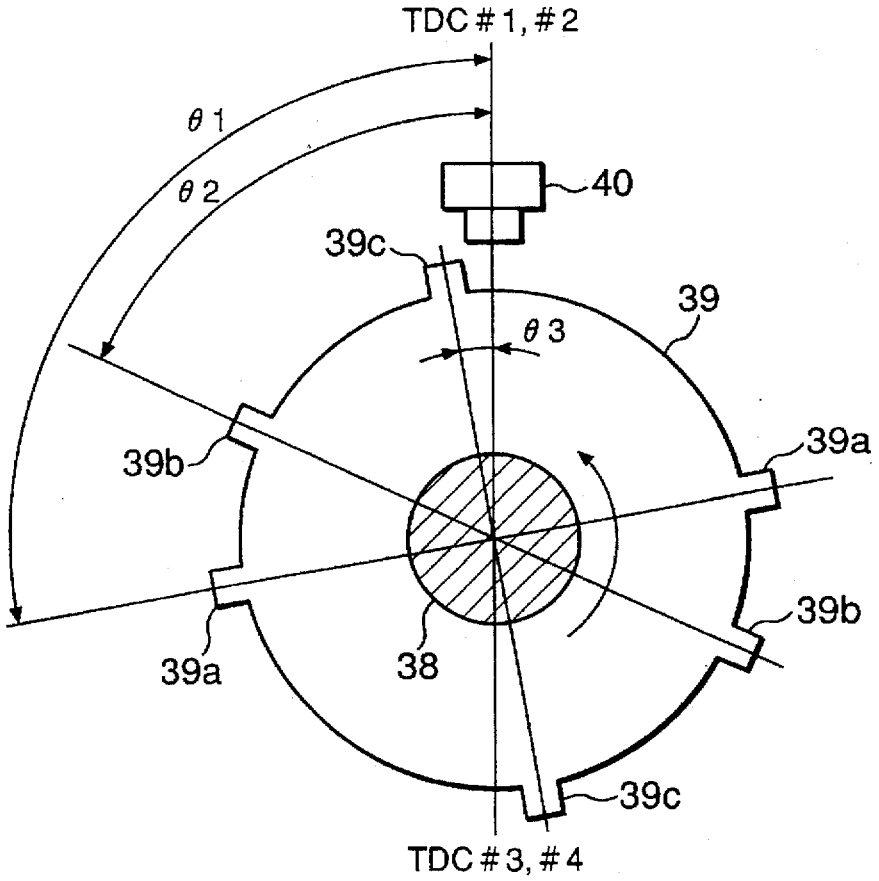
FIG. 3 is a front view showing a crank rotor and a crank angle sensor.

As shown in FIG. 3, the crank rotor 39 is provided with protrusions 39*a*, 39*b* and 39*c* at its outer periphery. The protrusions are located at positions corresponding to θ1, θ2, and θ3 that are before-compression top dead centers (BTDC) of cylinders #1, #2 and #3, and #4, respectively. In this embodiment, θ1=97° CA, θ2=65° CA, and θ3=10° CA.

The protrusions of the crank rotor 39 are detected by the crank angle sensor 40 that outputs crank pulses corresponding to θ1, θ2 and θ3 to the ECU 50 per ½ rotation (180° CA) of the engine 1. The ECU 50 measures input durations of the crank pulses from the crank angle sensor 40 and calculates an engine speed Ne.

Figure 4:
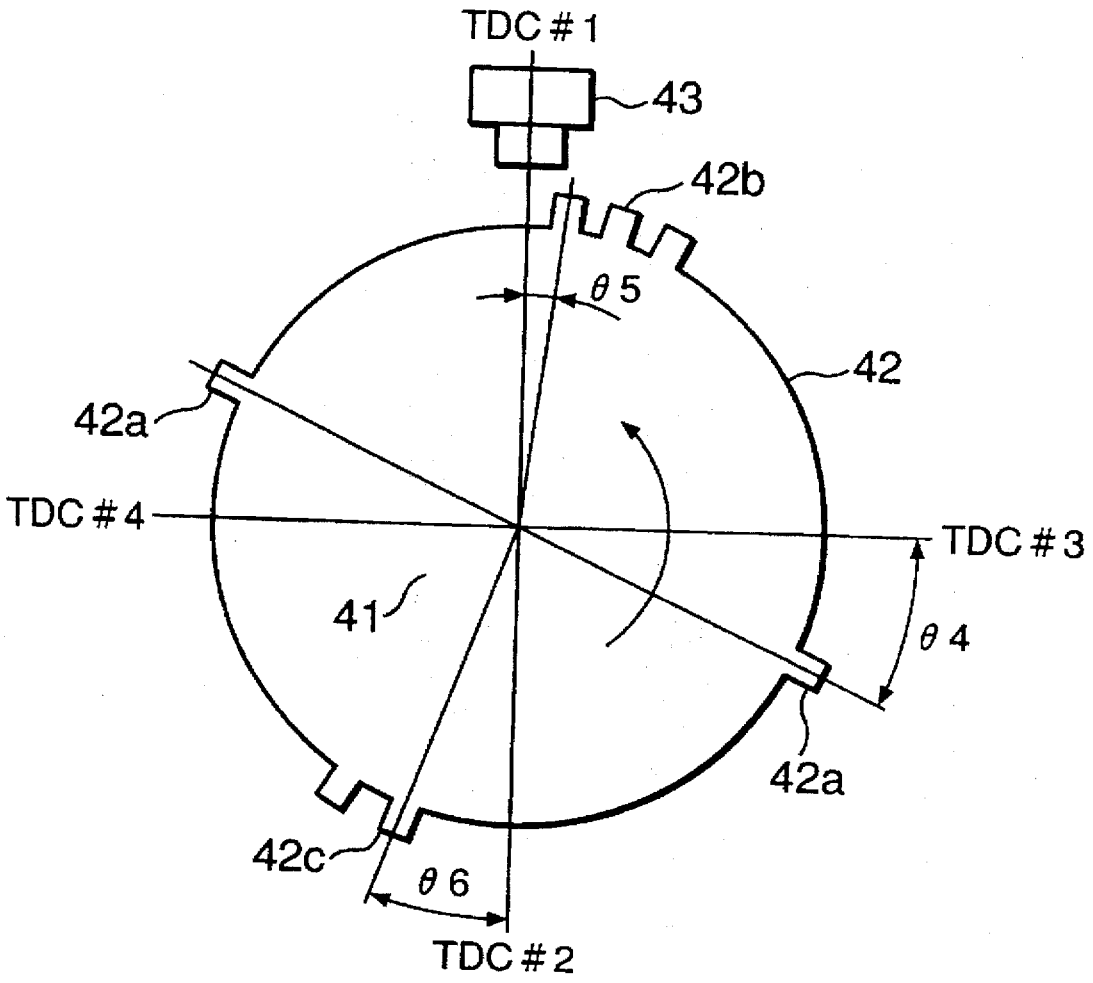
FIG. 4 is a front view showing a cam rotor and a cam angle sensor.

As shown in FIG. 4, the cam rotor 42 is provided with protrusions 42*a*, 42*b* and 42*c* at its outer periphery for determining a cylinder at the present combustion stroke. The protrusion 42*a* is located at a position corresponding to θ4 that is an after-compression top dead center (ATDC) of the cylinders #3 and #4. The protrusion 42*b* consists of three protrusions and the first one is located at a position corresponding to θ5 that is an after-compression top dead center (ATDC) of the cylinder #1. The protrusion 42*c* consists of two protrusions and the first one is located at a position corresponding to θ6 that is an after-compression top dead center (ATDC) of the cylinder #2. In this embodiment, θ4=20° CA, θ5=5° CA and θ6=20° CA. These protrusions are detected by the cam angle sensor 43 that outputs cam pulses to the ECU 50. The ECU 50 counts the cam pulses to determine a cylinder at the present stroke among combustion strokes in the order of the cylinders (#1→#2→#3→#4.)

Figure 5:
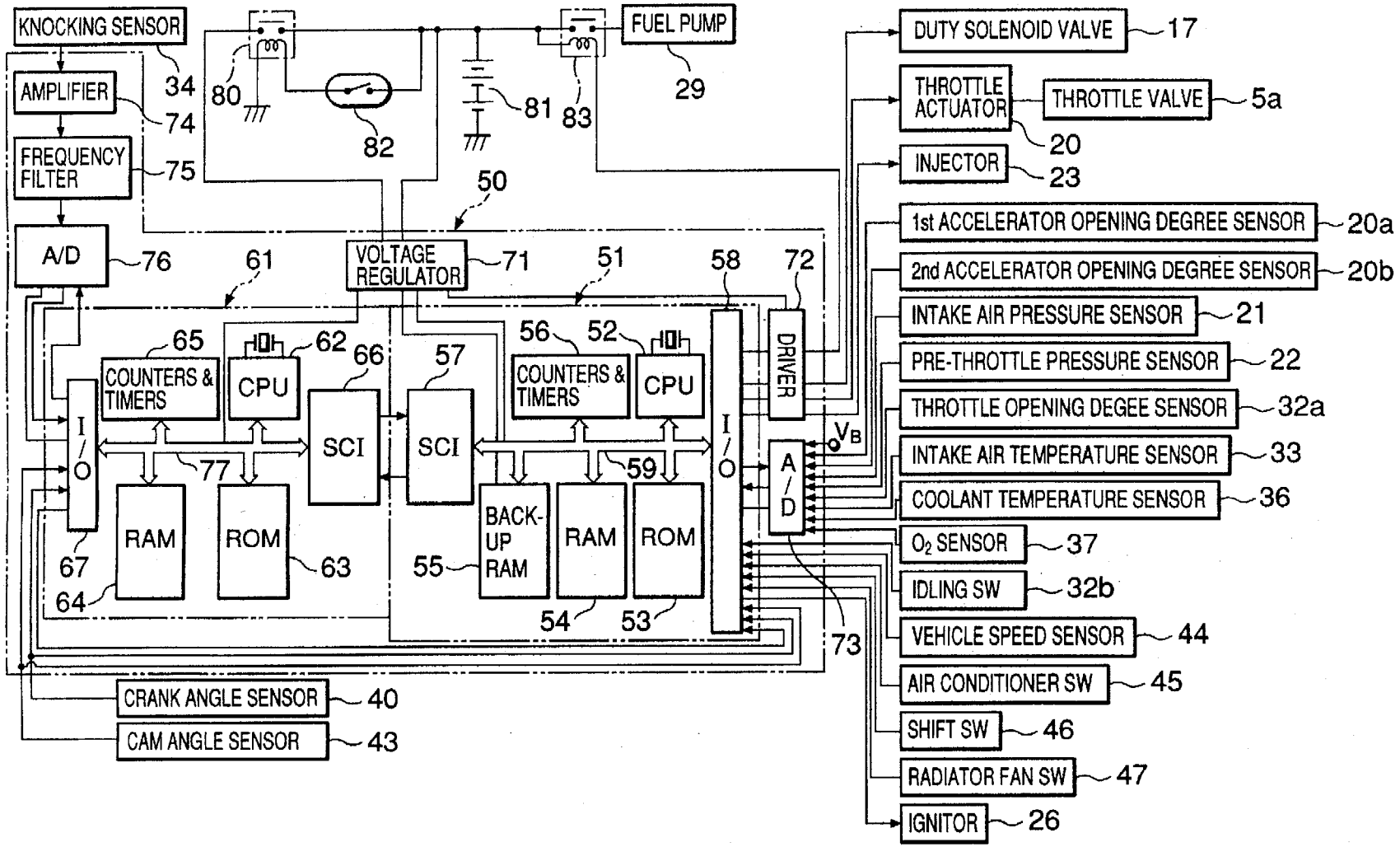
FIG. 5 is a block diagram showing an electric engine control apparatus according to the invention.

Described next is the ECU 50 with reference to FIG. 5. The ECU 50 includes a main computer 51 and a sub-computer 61. The main computer 51 controls fuel injection, an ignition timing, and a throttle opening degree, etc. On the other hand, the sub-computer 61 performs knocking detection only. Also incorporated in the ECU 50 are a voltage regulator 71 for supplying constant voltages to the circuits of the computers 50 and 61, a driver 72 and an A/D converter 73 both connected to the main computer 51, and various peripheral circuits connected to the sub-computer 61.

The voltage regulator 71 is connected to a battery 81 via a relay contact of a power relay 80. Also connected to the battery 81 is a relay coil of the power relay 80 via an ignition switch 82. The voltage regulator 71 is further directly connected to the battery 81. Supply voltages are supplied to various circuits of the ECU 50 from the voltage regulator 50 when the ignition switch 82 is turned on to close the relay contact of the power rely 80. Not only this, the voltage regulator 71 always supplies a back-up supply voltage to a back-up RAM 55 of the main computer 51 to hold data irrespective of the ignition switch 82. Connected further to the battery 81 is a fuel pump 29 via a relay contact of a fuel pump relay 83.

The main computer 51 is a micro-computer with a CPU 52, a ROM 53, a RAM 54, the back-up RAM 55, a set of counters and timers 56, a serial communications interface (SCI) 57, and an I/O interface 58 connected through a bus line 59 to each other.

The set of counters and timers 56 includes various counters, such as, free-run counters, a counter for counting cam pulses of a cam angle sensor signal, and various timers, such as, a fuel injection timer, an ignition timer, a periodical interruption timer for generating a periodical interruption, a timer for measuring input interval of crank angle sensor signals (crank pulses), and a watch dog timer for monitoring a system abnormality. Various software counters and timers are also incorporated in the main computers 51.

The sub-computer 61 is also a micro-computer with a CPU 62, a ROM 63, a RAM 64, a set of counters and timers 65, SCI 66, and an I/O interface 67 connected to each other through a bus line 77 to each other. The main computer 51 and sub-computer 61 are connected to each other through serial communications lines of the SCIs 57 and 66.

Connected to input ports of the I/O interface 58 of the main computer 51 are an idling switch 32*b*, a vehicle speed sensor 44, an air conditioner switch 45, a shift switch 46 for detecting a shift position of an automatic transmission, a radiator fan switch 47, the crank angle sensor 40, and the cam angle sensor 43.

Also connected to input ports of the I/O interface 58 via A/D converter 73 are the first and second accelerator opening degree sensor 20*a* and 20*b*, the intake air pressure sensor 21, the pre-throttle pressure sensor 22, the throttle opening degree sensor 32*a*, the intake air temperature sensor 33, the coolant temperature sensor 36 and the $O_2$ sensor. A battery voltage $V_B$ is also supplied, to be monitored, to one of the input ports of the I/O interface 58 via A/D converter 73.

Connected to output ports of the I/O interface 58 via driver 72 are the ignitor 26, the relay contact of the fuel pump relay 83, and various actuators, such as, the duty solenoid valve 17, throttle actuator 20, and injector 23.

Connected to input ports of the I/O interface 67 of the sub-computer 61 are the crank angle sensor 40 and cam angle sensor 43. Also connected to the I/O interface 67 is the knocking sensor 34 via amplifier 74, frequency filter 75, and A/D converter 76. A knocking detection signal from the knocking sensor 34 is amplified to a predetermined level by the amplifier 74. A frequency component of the amplified signal is extracted by the frequency filter 75 and converted into a digital signal by the A/D converter 76. The digital signal is then supplied to the I/O interface 67.

In response to detection signals from various sensors and switches, the main computer 51 controls engine conditions, such as fuel injection, an ignition timing, and a throttle opening degree. On the other hand, the sub-computer 61 performs knocking detection only. A sampling interval of the knocking detection signal from the knocking sensor 34 is determined based on the engine speed and load. The A/D converter 76 rapidly converts vibrated waveforms of the knocking signal into the digital signal. In response to the digital signal, the sub-computer 61 determines whether knocking is occurring.

Output ports of the I/O interface 67 of the sub-computer 61 are connected to the input ports of the I/O interface 58 of the main computer 51. Knocking judge data from the sub-computer 61 is supplied to the main computer 51 via I/O interfaces 58 and 67. On receiving the knocking judge data, the main computer 51 reads knocking data from the sub-computer 61 via SCIs 57 and 66 connected to each other through serial communications line. Based on the knocking data, the main computer. 51 delays the ignition timing of a knocking cylinder to cease the knocking.

When the ignition switch 82 is turned on, the power relay 80 is on and then the voltage regulator 71 feeds supply voltages to respective components of the main computer 50 to execute several control programs.

In detail, the CPU 52 executes a program stored in the ROM 53 to calculate several control parameters in response to the detection signals from the various sensors and switches supplied via I/O interface 58 and also the battery voltage Vb with various data stored in the RAM 54, various learning data stored in the back-up RAM 55, and predetermined data stored in the ROM 60.

The main computer 51 executes several control programs as follows:

Fuel injection control by supplying, at a predetermined timing, a drive signal to an injector 23 of a cylinder to be controlled, the drive signal corresponding to a calculated fuel injection amount;

Throttle valve opening degree control by supplying a drive signal to the throttle actuator 20, the drive signal corresponding to a calculated throttle opening degree; And, Ignition timing control by supplying an ignition signal to the ignitor 26 at a predetermined timing, the ignition signal corresponding to a calculated ignition timing.

As described above, the sub-computer 61 performs knocking detection only, which will be discussed later in detail.

Figure 6:
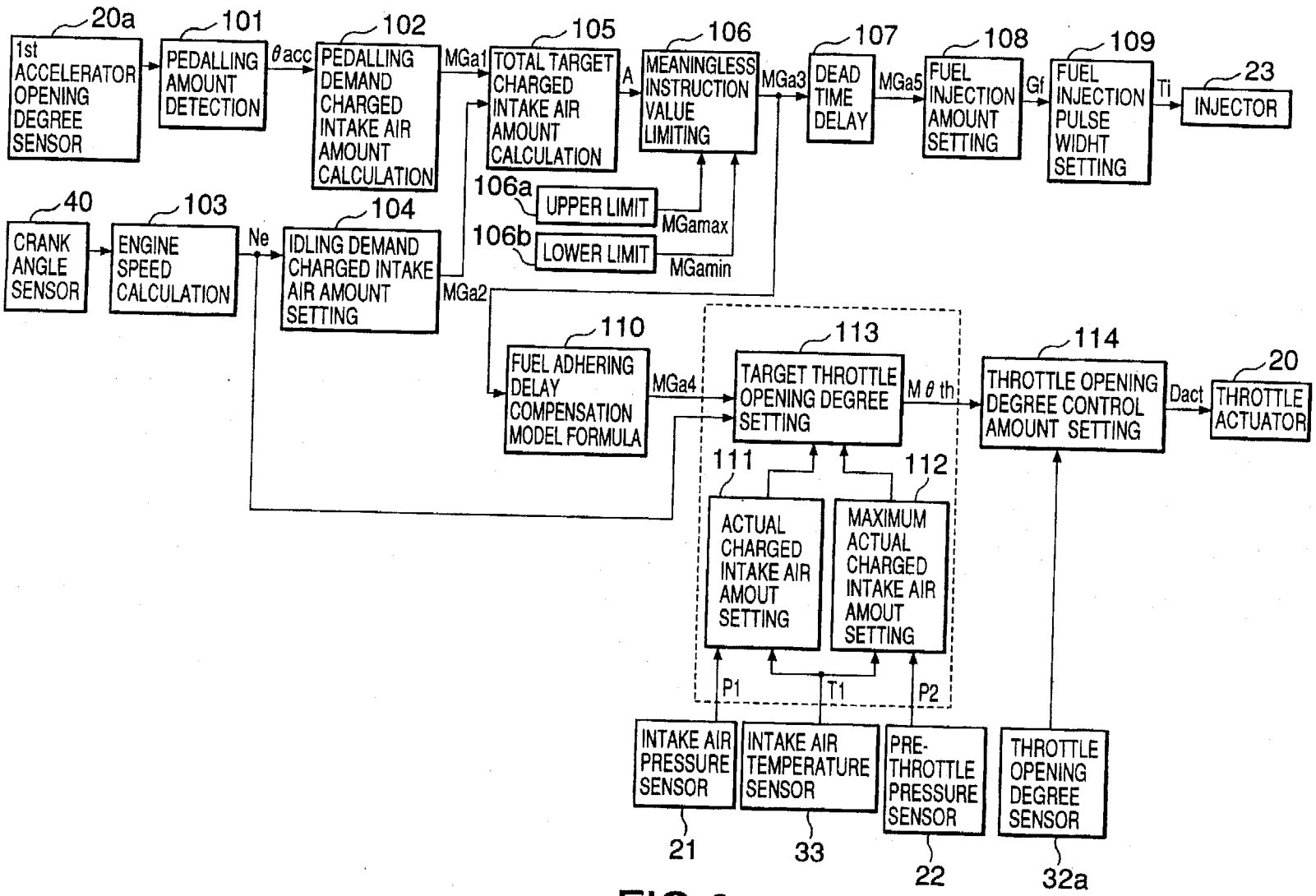
FIG. 6 is a block diagram explaining engine control of the apparatus shown in FIG. 5.

The fuel injection and throttle opening control by the main computer 51 will be described in detail with reference to FIG. 6.

In a step of accelerator pedalling amount detection 101, a pedalling amount θcc of the accelerator pedal 19 is detected based on an output value (a demand output of a driver) of the first accelerator opening degree sensor 20*a*.

Next, in a step of accelerator pedal demand charged intake air amount calculation 102, a target charged intake air amount (intake air mass per intake stroke of one cylinder) is calculated to match a driver's demand output, that is, an accelerator pedal demand charged intake air amount MGa1.

In a step of engine speed calculation 103, an engine speed Ne is calculated based on crank pulse intervals from the crank angle sensor 40.

Next, in a step of idling demand charged intake air amount setting 104, an idling demand charged intake air amount MGa2 is set to match an amount to cancel engine fiction at an idling speed based on the calculated engine speed Ne.

In a step of total target charged intake air amount calculation 105, a total target charged intake air amount A is calculated by adding the amounts Ga1 and Ga2 to each other. The amount A is used as a target value for the actual charged intake air amount GA sucked per intake stroke of one cylinder. Precisely, the amount A is used as an instruction value to set a fuel injection amount and a throttle valve opening degree.

Next, in steps of upper and lower limit value calculation 106*a* and 106*b*, upper and lower limit values Mgamax and MGamin are calculated to control the total target charged intake air amount A so as to neglect a meaningless instruction value.

In a step of meaningless instruction value limiting 106, the amount A is limited by the values Mgamax and MGamin. The limited value A is employed as a target charged intake air amount MGa3 for fuel amount calculation. The amounts to be set using the amount MGa3 are a fuel injection amount Gf and a throttle opening degree control amount in the fuel and air intake systems, respectively.

In the fuel system, a step of dead time delay processing 107 is executed to obtain a target charged intake air amount MGa5 for fuel amount calculation. This processing is executed so as to synchronize the fuel system with a delay in actuating the throttle valve 5*a* by the throttle actuator 20 of air intake system.

Next, in a step of fuel injection amount setting 108, a fuel injection amount Gf is set to obtain a target air-fuel ratio using the amount MGa5.

Based on the amount Gf, in a step of fuel injection pulse width setting 109, a fuel injection pulse width Ti is set for the injector 23.

On the other hand, in the air intake system, an intake air amount ΔMt is calculated by a fuel adhering delay compensation model formula (110). The amount ΔMt corresponds to a delay due to fuel adhering to an intake port inner wall in one cycle of a cylinder. The amount ΔMt is subtracted from the target charged intake air amount MGa3 for fuel amount calculation to obtain a target charged intake air amount MGa4 to be used as a reference for throttle opening degree setting.

After the compensation of delay due to fuel adhering, a throttle opening degree is set by a reverse chamber model formula.

In a step of actual charged intake air amount setting 111, an actual charged intake air amount Ga is calculated based on an intake pipe absolute pressure P1 and an intake air absolute temperature T1. The pressure P1 is detected by the intake air pressure sensor 21 at the downstream side of the throttle valve 5*a*. The temperature T1 is detected by the intake air temperature sensor 33.

Further, in a step of maximum actual charged intake air amount setting 112, a maximum actual charged intake air amount Gamax is calculated based on a pre-throttle pressure P2 and the intake air temperature T1. The pressure P2 is detected by the pre-throttle air pressure 22 at the upstream side of the throttle valve 5*a*.

Then, in a step of target throttle opening degree setting 113, firstly, a mean value of the actual charged intake air amount Ga and target charged intake air amount MGa4 is calculated. The ratio of the mean value to the amount Gamax is calculated and normalized to obtain an intake air supply ratio SGa (a normalized target charged intake air amount.) An increase or a decrease in engine speed is calculated based on the amounts Ga and MGa4. The calculated increase or decrease is then added to the engine speed Ne to obtain an engine speed indicating value MNe. Finally, a target throttle opening degree MΘth is set based on the ratio SGa and the value MNe.

Next, in a step of throttle opening degree control amount setting 114, firstly, an actual throttle opening degree Θth detected by the throttle opening degree sensor 32*a* is subtracted from the target opening degree MΘth to obtain a throttle opening degree difference ΔΘth. Then, a throttle actuator driving amount Da is set based on the difference ΔΘth. The drive amount Da is a throttle opening degree control amount for the throttle actuator 20.

The fuel injection and throttle opening degree control will be described in detail later with flow charts.

The basic principle of the present invention will he discussed first. Set is a target charged air intake amount after an elapse of small time At that is an intake air mass [g] per intake stroke of one cylinder. This amount is set based on various parameters indicating engine conditions, such as, the pedalling amount Θacc of the accelerator pedal 19 and the engine speed Ne over the entire driving range from engine start to stop.

A fuel injection amount to obtain a desired air-fuel ratio and a dynamic opening degree of the throttle valve 5*a* are set based on the target charged air intake amount. The dynamic opening degree is set so that an air intake amount to be supplied to a cylinder to obtain a desired air-fuel ratio becomes the target charged air intake amount after an elapse of time Δt. Actually, the dynamic opening degree is set using a reverse chamber model formula. This formula is used to obtain an opening degree of the throttle valve 5*a* at which an air intake amount after an elapse of time Δt becomes the target charged air intake amount.

An air mass flow amount AvQth [g/sec] that passes in a steady state through a throttle valve of a 4-cycle & 4-cylinder engine is expressed by the following expression:

$$AvQth=2Ne.Mga/60 \quad (1)$$

where Ne [rpm] and MGa [g] denote an engine speed and a target charged air intake amount, respectively, and MGa=Ga (Ga: actual charged intake air amount) in a steady state.

The throttle opening degree Θth in the steady state is thus also obtained based on the engine speed Ne and target charged air intake amount MGa. More in detail, the opening degree Θth is expressed by the following function:

$$\Theta th=f(Mga/Gamax, Ne) \quad (2)$$

with a parameter obtained by normalizing the maximum actual charged intake air amount Gamax corresponding to the target charged intake air amount Mga at throttle valve full open.

The expression (1) is analyzed after an elapse of time Δt from the point of input/output relationship to a chamber volume from the downstream side the throttle valve 5*a* to the intake port 2*a* of each cylinder.

The reverse chamber model formula is used to calculate an air flow amount Gth that passes through the throttle valve. The air flow amount Gth is required to match an actual charged intake air amount Ga to the target charged intake air flow amount MGa under a specific condition. The actual charged intake air amount Ga is to be supplied to the engine after an elapse of time Δt.

Figure 7:
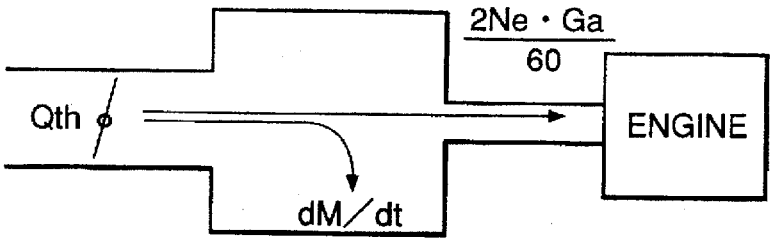
FIG. 7 is a view showing an engine chamber model.
Figure 8:
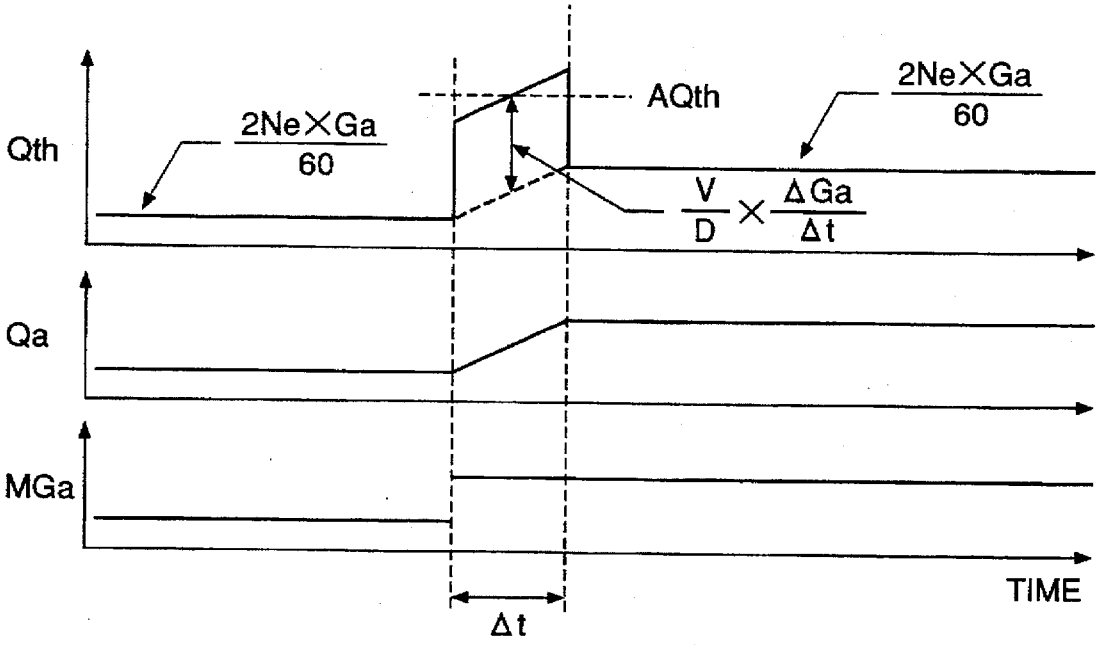
FIG. 8 is a time chart explaining a relationship among an air amount passing a throttle valve, an actual charged intake air amount and a target charged intake air amount.

An air mass flow amount Qth that passes through the throttle valve in a transitional period is considered as addition of intake mass change (dM/dt) in chamber volume and intake air mass flow amount (2Ne×Ga/60) to an engine as shown in FIG. 7. That is, $$Qth=dM/dt+2Ne\times Ga/60 \quad (3)$$

It is assumed that air density in a chamber and that in each cylinder is almost equal to each other at the last stage of an air intake stroke. In this case, the following relationship is established:

$$M/V=Ga/D \quad (4)$$

where V and D denote a chamber volume and a volume per cycle, respectively.

Further, the following expression is established when a change in air mass M in a chamber is expressed by an expression of the actual charged intake air amount Ga:

$$dM/dt=V/D.dGA/dt \quad (5)$$

The air mass flow amount Qth that passes through the throttle valve in a transitional period is then obtained as follows by putting the expression (5) into the expression (3):

$$Qth=(2Ne.Ga/60)+(V/D).dGa/dt \quad (6)$$

Then, $$Qth=AvQth+V/D.dGa/dt \quad (7)$$

The air mass flow amount Qth that passes through the throttle valve in the transitional period thus can be expressed as addition of an air change in the chamber to the air flow amount AvQth that passes through the throttle valve in the steady state. Further, since V/D is constant, Qth can be expressed, like AvQth, as a function of the actual charged intake air amount Ga and the engine speed Ne according to the expression (6).

In the discrete-time system, an average intake air flow amount AQth that passes through the throttle valve within a time Δt is expressed as follows using a varied target charged intake air amount Mga:

$$AQth=(2Ne.AGa/60)+V/D.\Delta Ga/\Delta t \quad (8)$$

where AGa denotes a mean charged intake air amount in a steady state.

The expression (8) can be established when it is assumed that the actual charged intake air amount Ga (an intake air amount actually supplied to a cylinder) follows the change in the target charged intake air amount MGa and becomes equal to MGa after an elapse of time Δt at a constant engine speed.

As discussed above, the mean charged intake air amount AGa is $$AGa=(Ga+MGa)/2 \tag{9}$$

when the actual charged intake air amount Ga follows the target charged intake air amount MGa.

Further, the charged intake air amount change ΔGa is $$\Delta Ga=MGa-Ga \tag{10}$$

Putting the expressions (9) and (10) into the expression (8) obtains $$AQth=2Ne.\{(Ga+MGa)/2\}/60+V/D.(MGa-Ga)/\Delta t \tag{11}$$

And, multiplying the second term of the right side of the expression (11) by (60.AGa)/(60.AGa) obtains, since AGa=(Ga+MGa)/2, $$\begin{aligned} AQth &= \frac{2Ne\cdot\frac{Ga+MGa}{2}}{60}+\frac{2\cdot\frac{60\cdot V(MGa-Ga)}{D\cdot\Delta t(Ga+MGa)}\cdot\frac{Ga+MGa}{2}}{60} \\ &= \frac{2\cdot\left[Me\cdot\frac{60\cdot V(MGa-Ga)}{D\cdot\Delta t(Ga+MGa)}\right]\cdot\frac{Ga+MGa}{2}}{60} \end{aligned} \tag{12}$$

It is understood from the expression (12) that the intake air flow amount Qth that passes through the throttle valve after an elapse of time Δt in the transitional period obtained by substituting the following expression (a) for MGa of the expression (1):

$$(Ga+MGa)/2 \tag{a}$$

and further, the following expression (b) for Ne of the expression (1):

$$Ne+\{60V.(MGa-Ga)/D.\Delta t.(Ga+MGa)\} \tag{b}$$

The second term of the expression (b) represents an increase or a decrease of the engine speed Ne. And, the expression (b) denotes the engine speed indicating value MNe.

Thus, the expression (1) for AvQth in the steady state can be used with the parameter change for the calculation of Qth in the transitional state.

The air flow amount Qth at the maximum horse power or at rapid acceleration is more than 100 times as much as a low flow amount during idling.

More in detail, the air flow amount Qth is in the dimension of time. For example, Qth varies 10 times or more between full throttle at an engine speed of 700 rpm and complete throttle valve closing at the same engine speed. When the maximum engine speed is 7000 rpm, Qth becomes 10 times as much as that at 700 rpm. Therefore, since 10×10=100, Qth at the maximum engine speed at full throttle valve becomes more than 100 times as much as than that during idling. When 1/100 precision is desired to obtain, dynamic range becomes 10,000 times or more.

Therefore, computer calculation load will increase to obtain highly precise and the same control precision over all control regions by setting the throttle opening degree θth using the air flow amount Qth that passes the throttle valve under the above high dynamic range. This results in a computer of high speed and large capacity being required. A conventional computer for engine control cannot endure such a heavy calculation load to meet the demand.

However, the present invention does not directly obtain the air flow amount Qth that passes the throttle valve. The air flow amount Qth is set by referring to the map based on the engine speed indicating value MNe and an intake air supply ratio SGa. The ratio SGa is a ratio of a mean charged intake air amount AGa=(Ga+MGa)/2 of time Δt to the maximum actual charged intake air amount Gamax at full throttle.

$$\begin{aligned} \theta th &= f[SGa, MNe] \\ &= f\left[\frac{(Ga+MGa)/2}{Gamax}\ Ne+\frac{60V\cdot(MGa-Ga)}{D\cdot\Delta t(Ga+MGa)}\right] \end{aligned} \tag{13}$$

In a steady period, the actual charged intake air amount Ga and the target charged intake air amount MGa are equal to each other. And, hence the expression (13) becomes equal to the expression (2) and can be used in the steady period. In another word, the throttle opening degree θth setting in both the transitional and steady periods can be done with the simple expression. Further, θth setting in the steady state can be done using the expression (2) instead of the expression (13). More in detail, the ratio of the target charged intake air amount MGa to the maximum actual charged intake air amount Gamax is calculated to normalize MGa (MGa/Gamax). The normalized MGa and the engine speed Ne are used to set the throttle opening degree control amount.

In this invention, a fuel amount corresponding to a target air-fuel ratio can be directly set based on the target charged intake air amount MGa. This results in no delay in the fuel system in theory. However, there is a delay due to fuel adhering until fuel reaches the cylinder. Further, there is a delay in the air intake system due to a delay in actuating the throttle valve 5*a* by the throttle actuator 20. This delay happens even though the reverse chamber model formula is used to calculate the throttle opening degree for the minimum delay of intake air reaching into the cylinder.

In this regard, conventional L- and D-Jetronic control systems have the following relationship between the air intake system and fuel system: an intake air amount to be supplied to a cylinder is measured first by an intake air amount sensor and intake port pressure sensor; and then a fuel injection amount is set based on the measured intake air amount. This results in that the delays produced in both the air intake system and fuel system are integrated.

Discussed below is a tracking delay in a drive-by-wire system. The tracking delay is produced until an engine torque actually increases after an accelerator pedal is depressed.

Figure 9:
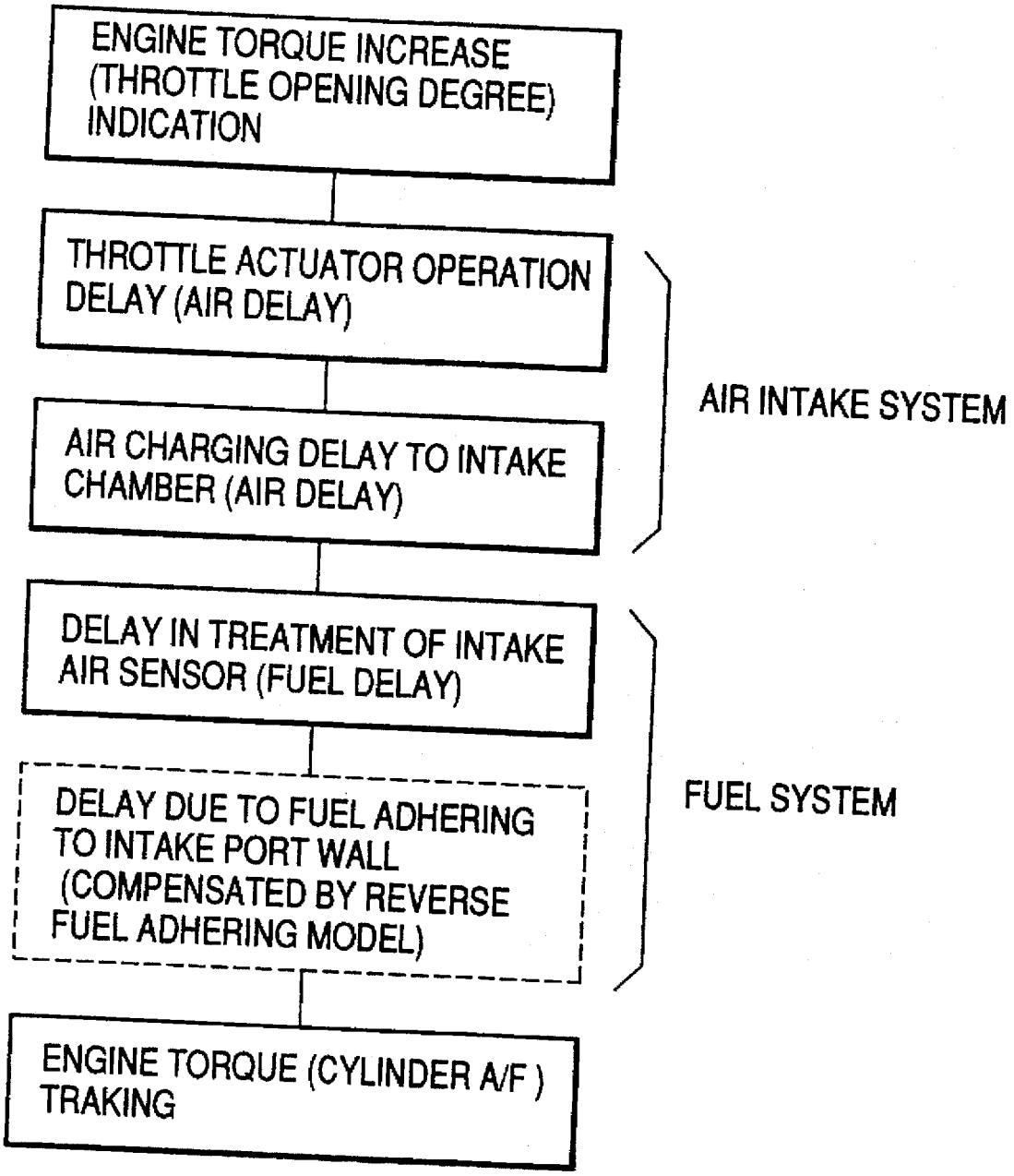
FIG. 9 is an explanatory view of a relationship between delays caused in an air intake system and a fuel system of a conventional engine control system.

As shown in FIG. 9, in the air intake system:

(1) produced first is a delay of increase in air amount that passes a throttle valve due to delay in actuating the throttle valve by the throttle actuator; and, (2) produced second is a delay in charging air into an air intake chamber when a throttle valve is opened.

This results in increase in intake air amount to be supplied to a cylinder in a transitional period with integrated delays (1) and (2).

Next in the fuel system, following the delay in the air intake system:

(3) a delay is produced due to air amount measuring by a sensor, the delay being produced due to averaging for removing pulsation of air intake pressure at the downstream side of a throttle valve in the D-Jetronic system or the delay being produced in an intake air amount sensor used in the L-Jetronic system; and, (4) next, a delay is produced due to fuel adhering to the inner wall of an intake port while fuel injected by an injector reaching a cylinder, the adhered fuel flowing along the wall or being evaporated again and flowing into the cylinder.

The delays discussed above serially affect supply of increased intake air and fuel to the cylinder to increase engine torque.

Figure 10:
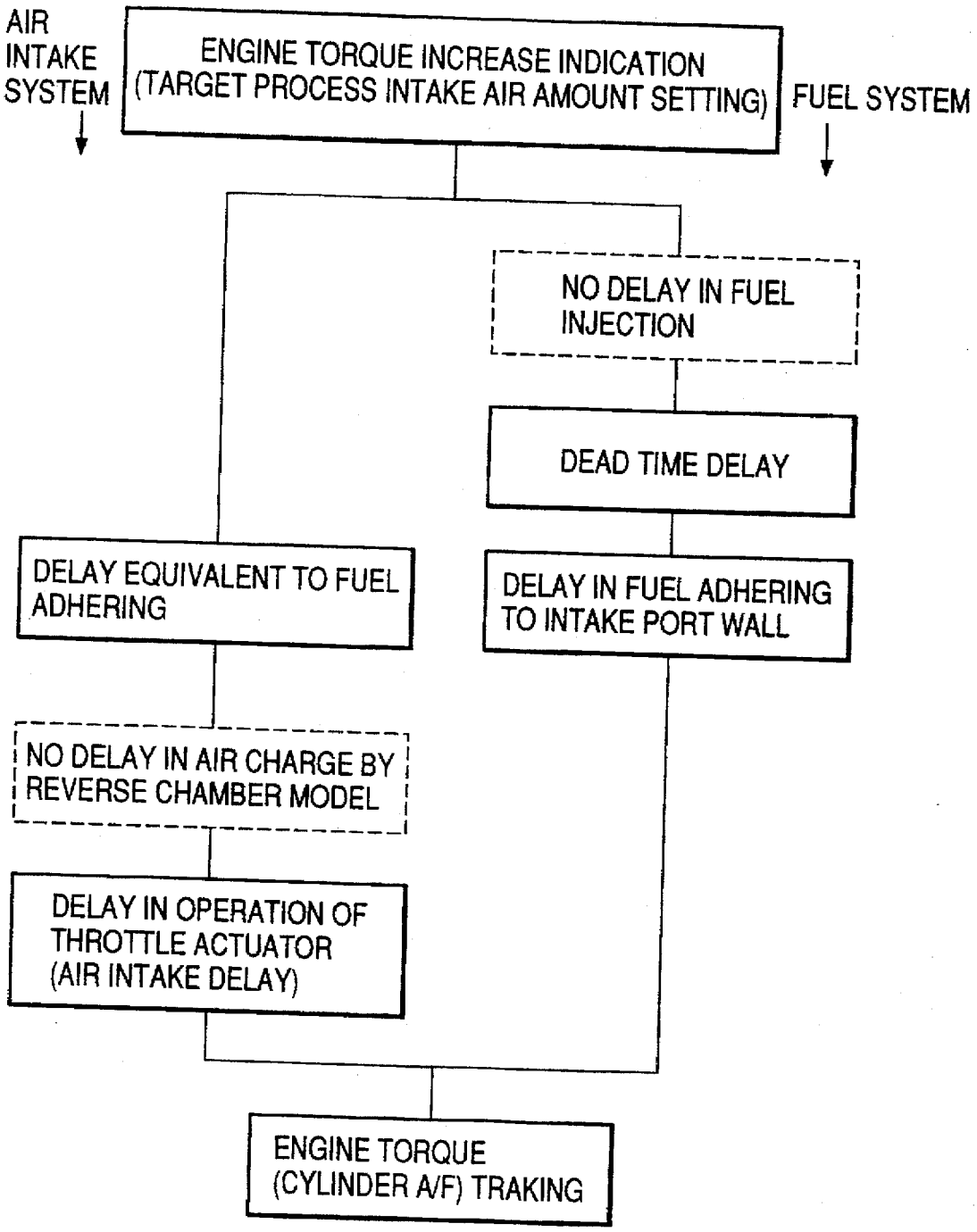
FIG. 10 is an explanatory view of a relationship between delays caused in an air intake system and a fuel system of the engine control system according to the invention.

On the other hand, in the present invention, the air intake system and fuel system are controlled in parallel as shown in FIG. 10. That is, the target charged intake air amount MGa which is proportional to the engine torque is used as a parameter to calculate both a fuel injection amount and a throttle valve opening degree in parallel. In fact, a delay is produced due to fuel adhering to an inner wall of an intake port. Also in the air intake system, a delay in operation of the throttle actuator is produced even though the reverse chamber model formula is used to set a throttle opening degree so that intake air reaches into the cylinder with the minimum delay.

However, in the present invention, as discussed above, delays due to fuel adhering and operation of the throttle actuator are not integrated because the fuel system and air intake system are controlled in parallel.

The fuel injection and throttle opening degree control by the ECU 50 discussed above will be disclosed with reference to the attached flow charts.

Disclosed first is the intake air loss mass and volume efficiency setting routine shown in FIG. 11. This routine is executed per predetermined period, such as 50 msec. In steps S1 and S2, one-dimensional map is referred to with interpolation calculation based on the engine speed Ne to set intake air loss mass $\eta b$ and volume efficiency $\eta v$, respectively, and the routine ends.

The actual charged intake air amount Ga and a theoretical intake air amount Gath calculated based on gas density $\rho 1$ are proportional to each other. This relationship can be indicated almost as a linear function as shown in FIG. 12. In the figure, the volume efficiency $\eta v$ is represented by the slope of the linear function. Further, the intake air loss mass $\eta b$ is represented by a point of contact with the lateral axis at which the actual charged intake air amount Ga becomes zero before the theoretical charged intake air amount Gath becomes zero (complete vacuum). The volume efficiency $\eta v$ and intake air loss mass $\eta b$ are both theoretically constant. However, these values should be set depending on engine speed because they actually vary due to cam movement per engine speed.

FIG. 13 shows one example of one-dimensional map. This map is to be referred to in setting $\eta v$ and $\eta b$. The present invention employs an eight lattice-one dimensional map.

Figure 14:
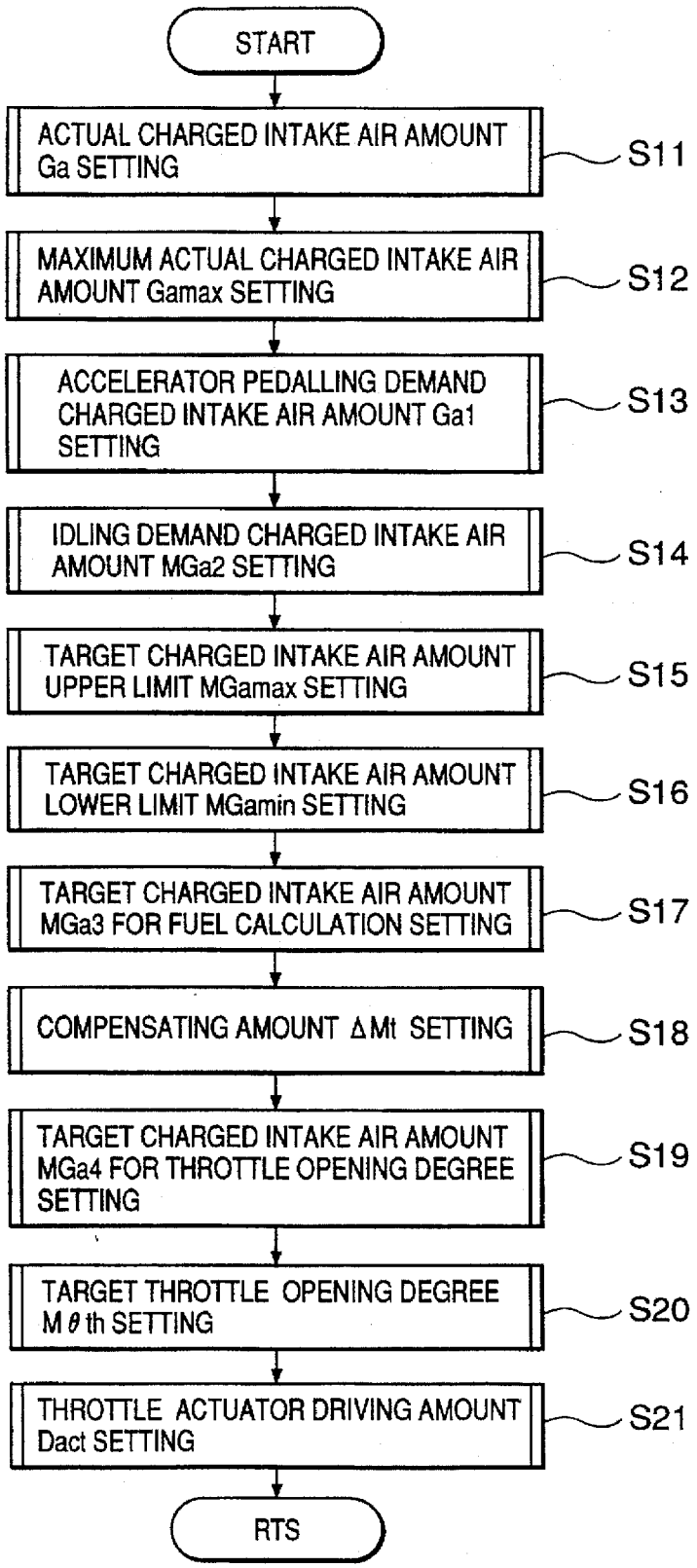
FIG. 14 is a flow chart of a throttle opening degree control routine.

The volume efficiency $\eta v$ and intake air loss mass $\eta b$ are red in a throttle opening degree control routine shown in FIG. 14. This routine is executed per predetermined period, such as 10 msec. Each subroutine (STEPS S11 to S21) calculates physical quantity required for throttle opening degree control. The routine shown in FIG. 14 will be disclosed below in detail.

STEP S11

Figure 15:
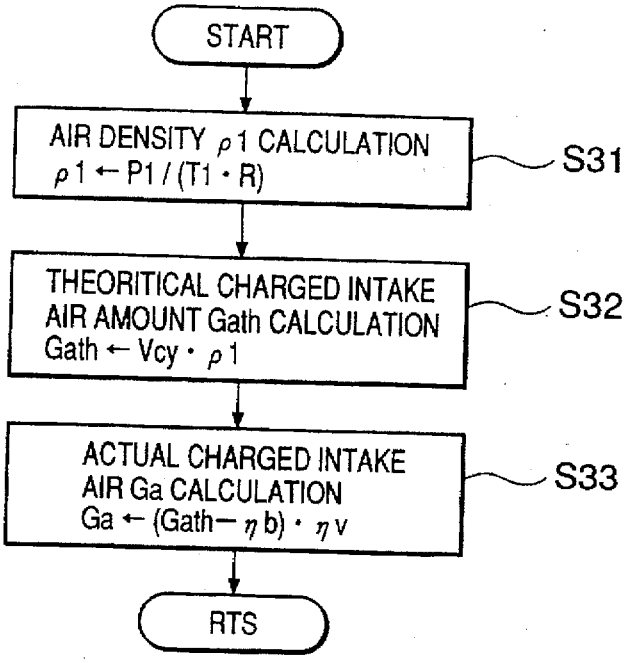
FIG. 15 is a flow chart of an actual charged intake air amount setting subroutine.

In this step, an actual charged intake air amount setting routine is executed as shown in FIG. 15 to set the actual charged intake air amount Ga.

As shown in FIG. 15, air density $\rho 1$ at the downstream side of the throttle valve 5*a* is calculated by $$\rho 1 \leftarrow P1/(T1.R),\ R\text{: gas constant}$$

based on the air intake pipe absolute pressure P1 at the downstream side of the throttle valve 5*a* and intake air temperature T1 in step S31.

A stroke volume is multiplied by the air density $\rho 1$ to calculate the theoretical charged intake air amount Gath ($Gath \leftarrow Vcy.\rho 1$) in step 32. The stroke volume is the volume to be removed by a piston per stroke.

Next in step 33, the actual charged intake air amount Ga is calculated by a linear function $Ga \leftarrow (Gath - \eta b).\eta v$ based on the theoretical intake air amount Gath (FIG. 12), and the subroutine ends.

STEP S12

In STEP S12 shown in FIG. 14, a maximum actual charged intake air amount setting subroutine is executed. The detail of this subroutine is described in FIG. 16. This routine calculates the maximum amount Gamax of the charged intake air amount Ga charged in one cylinder per intake stroke.

Figure 16:
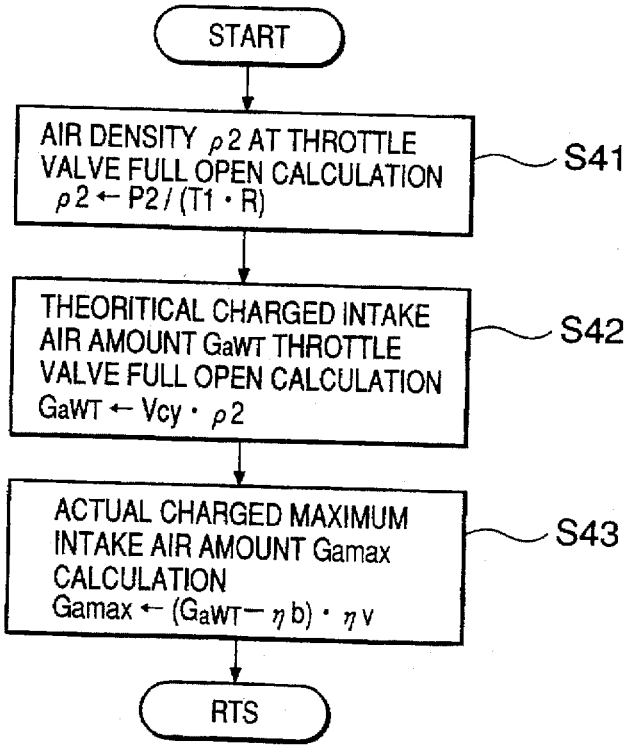
FIG. 16 is a flow chart of the maximum actual charged intake air amount setting subroutine.

As shown in FIG. 16, air density $\rho 2$ at the downstream side of the throttle valve 5*a* at full throttle is calculated by $$\rho 2 \leftarrow P2/(T1.R)$$

based on the pre-throttle pressure P2 at the upstream side of the throttle valve 5*a* and intake air temperature T1 in step S41.

Next in step S42, a theoretical charged intake air amount GaWT at full throttle is calculated by $$GaWT \leftarrow Vcy.\rho 2$$

And in step S43, the maximum actual charged intake air amount Gamax to be supplied to a cylinder is calculated based on the theoretical charged intake air amount GaWT at full throttle, the intake air loss $\eta b$ and the volume efficiency $\eta v$ $\{Gamax \leftarrow (Gawt - \eta b).\eta v\}$, and the subroutine ends.

STEP S13

In STEP S13 shown in FIG. 14, a demand charged intake air amount setting subroutine is executed. The detail of this subroutine is shown in FIG. 17.

Figure 17:
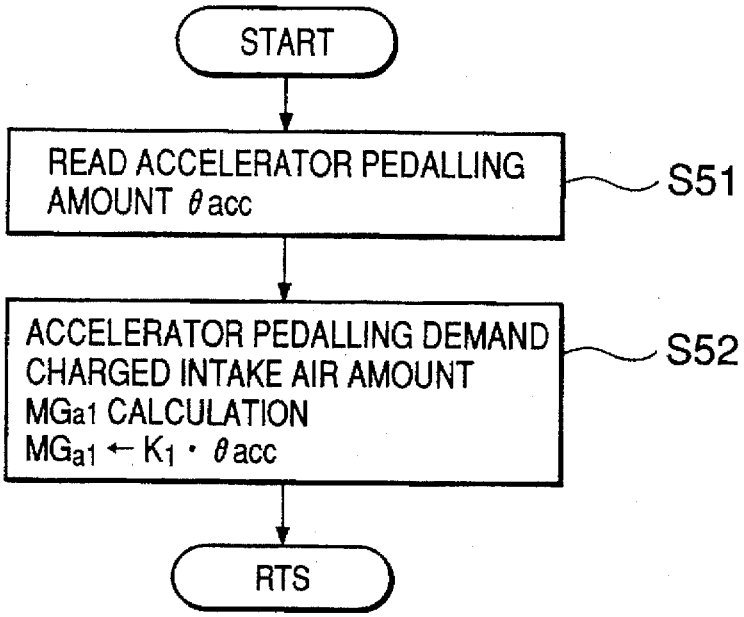
FIG. 17 is a flow chart of an accelerator pedal demand charged intake air amount setting subroutine.

As shown in FIG. 17, an accelerator pedalling amount $\theta acc$ is red in step S51. And, in step S52, an accelerator pedalling demand charged intake air amount MGa1 is calculated by $$MGa1 \leftarrow K1.\theta acc,\ K1\text{: constant}$$

and, the subroutine ends.

The accelerator pedalling amount $\theta acc$ represents the driver's demand output. Therefore, this subroutine sets a target value of the charged intake air amount corresponding to the driver's demand output.

In the present invention, the accelerator pedalling demand charged intake air amount MGa1 is set as a function proportional to the accelerator pedalling amount $\theta acc$. An unreal value of the demand charged intake air amount MGa1 is thus set with this function when, for example, the throttle valve is fully opened at engine speed of 1000 rpm. However, there is no out of control because MGa1 is limited by an upper limit value MGamax for the target intake air amount. In setting MGa1, the engine speed Ne, vehicle speed, transmission ratio, skid, a distance from a car running ahead, etc., can be considered besides $\theta acc$.

STEP S14

In STEP S14 of FIG. 14, an idling demand charged intake air amount setting subroutine is executed. The detail of this subroutine is shown in FIG. 18.

Figure 18:
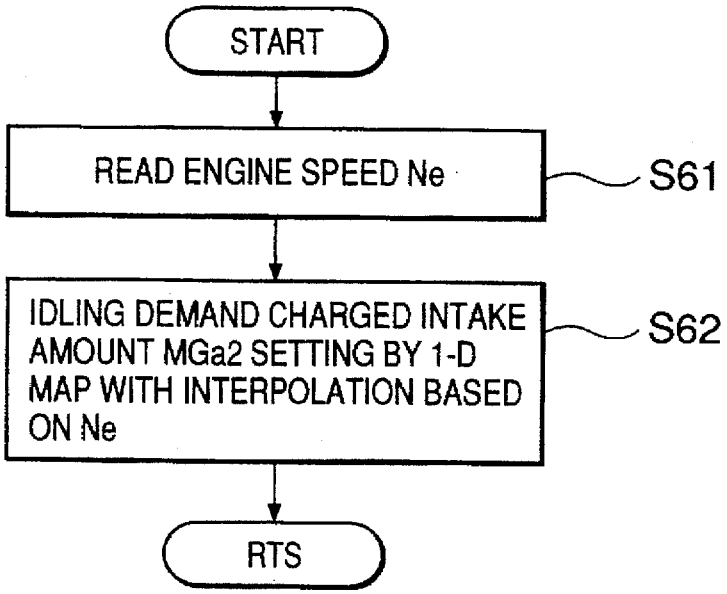
FIG. 18 is a flow chart of an idling demand charged intake air amount setting subroutine.

As shown in FIG. 18, a demand charged intake air amount MGa2 while idling is set in this subroutine. Firstly, the engine speed Ne is red in step S61. The amount MGa2 is set by referring to one-dimensional map with interpolation calculation based on Ne in step S62, and the subroutine ends.

Figure 19:
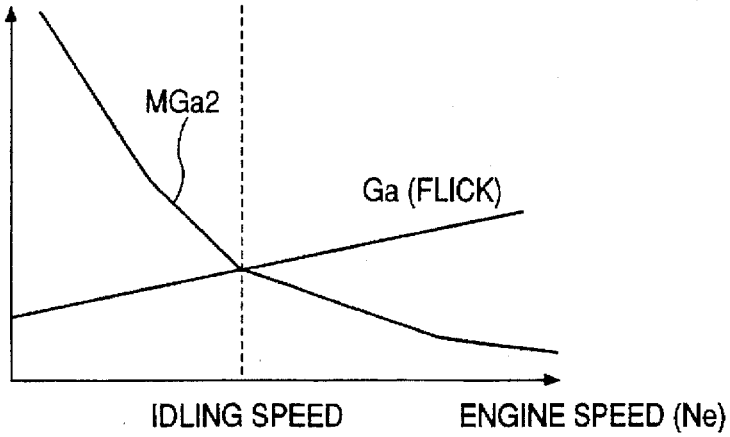
FIG. 19 is an explanatory view of one dimensional map for the idling demand charged intake air amount setting.

FIG. 19 shows the characteristics of the one-dimensional map used in step S62. The demand charged intake air amount MGa2 is set so as to cancel engine friction at an idling engine speed. Further, the amount MGa2 is set such that the lower Ne the larger MGa2 while the higher Ne the smaller MGa2. Steady idling is thus achieved by changing MGa2 in accordance with the characteristics of FIG. 19. Further steady idling is achieved by adding various factors to MGa2. The factors are, for example, a coolant temperature detected by the coolant temperature sensor 36, idling up while an air conditioner is on, feedback control to target idling engine speed.

STEP S15

Figure 20:
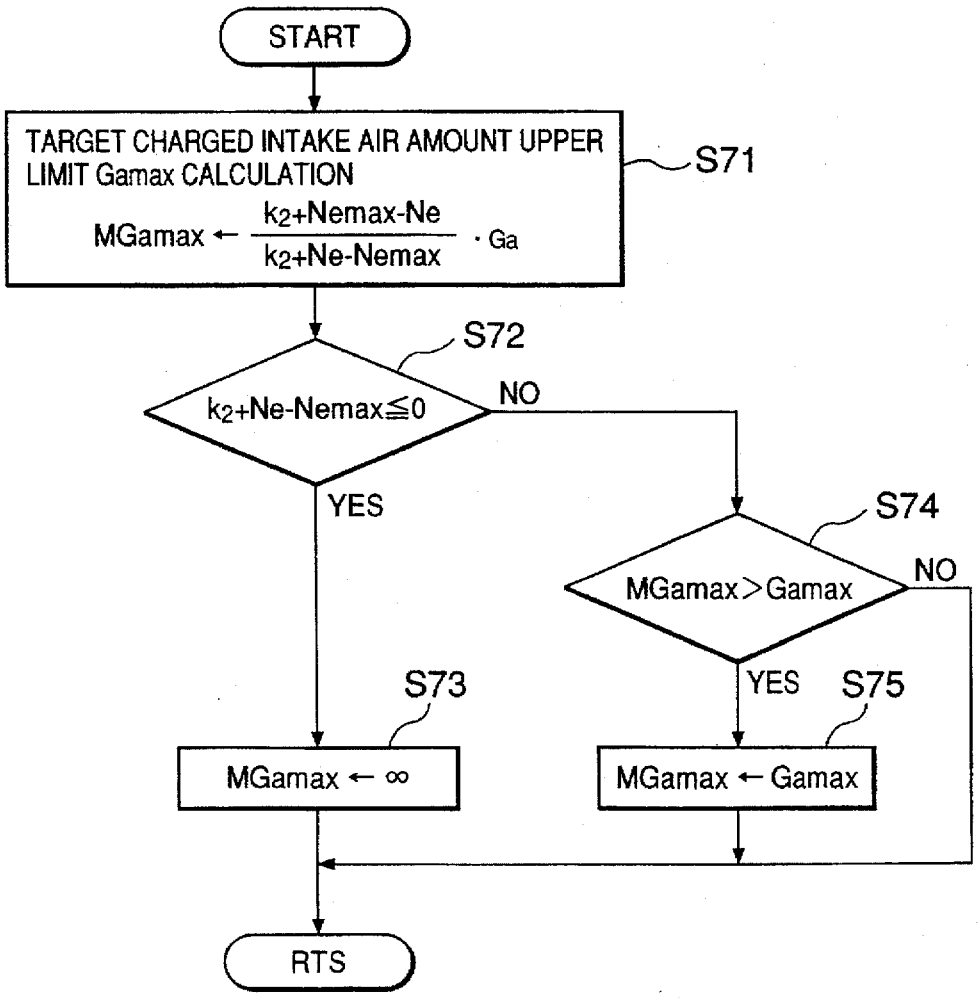
FIG. 20 is a flow chart of a target charged intake air amount upper limit value setting subroutine.

In STEP S15 shown in FIG. 14, a target charged intake air amount upper limit value setting subroutine is executed. The detail of this subroutine is shown in FIG. 20. This subroutine sets the upper limit value of the target charged intake air amount at which reverse calculation by the reverse chamber model formula is of no use.

As shown in FIG. 20, the upper limit value MGamax of the target charged intake air amount is calculated in step S71 by $$MGamax \leftarrow \{(K2+Nemax-Ne)/(K2+Ne-Nemax)\}.Ga \quad (14)$$

based on the actual charged intake air amount Ga, an engine speed and the predetermined maximum engine speed Nemax. In the expression, K2=60V/D.Δt, that is, K2 is a constant depending on an engine. Further, Nemax is a value with a margin, such as 12,000 [rpm], beyond an actual critical engine speed.

In the invention, a throttle opening degree is set, as disclosed later, by referring to a map based on an intake air supply ratio SGa that expresses a ratio of a mean charged intake air amount to the maximum actual charged intake air amount Gamax and the engine speed indicating value MNe.

In this regard, the maximum engine speed lattice of the map is set at the value Nemax. This is because, if set at a value close to an actual critical engine speed, there is no margin of controllability near the critical engine speed.

Next, in step S72, determination is made whether (K2+Ne−Nemax) in the expression (14) is zero or less (K2+Ne−Nemax)≦0). If so or smaller than zero, the subroutine goes to step S73. The target charged intake air amount upper limit value MGamax is set as infinity (MGamax←∞) in step S73, and the subroutine ends.

If larger than zero in step S72, the subroutine goes to step S74. Comparison is made between MGmax and Gamax in step S74. If the former is larger than the latter, the subroutine ends. If Gamax is larger than MGamax, the subroutine goes to Step S75 to set MGamax at Gamax (MGamax←Gamax), then the subroutine ends.

The reason why the target charged intake air amount MGamax is set is as follows:

As disclosed, in the invention, the throttle opening degree is set by the reverse chamber model formula. However, a theoretically correct air-fuel ratio control cannot be carried out if the target charged intake air amount MGa as one element of the expression (13) for determining the engine speed indicating value MNe is too large with the result that MNe exceeds the maximum value of engine speed lattice of the map.

More in detail, MNe can be expressed as follows:

$$Ne + \frac{60V \cdot (MGamax - Ga)}{D \cdot \Delta t \cdot (Ga + MGamax)} = Nemax$$

$$(Ne - Nemax) \cdot D \cdot \Delta t \cdot (Ga + MGamax) = 60V \cdot (Ga - MGamax)$$

$$MGamax = \frac{\frac{60V}{D \cdot \Delta t} + Nemax - Ne}{\frac{60V}{D \cdot \Delta t} + Ne - Nemax} \cdot Ga = \frac{K2 + Nemax - Ne}{K2 + Ne - Nemax} \cdot Ga \quad (15)$$

Therefore, the target charged intake air amount upper limit value MGamax is set as infinity in step S73 when the denominator (K2+Ne−Nemax) is zero or a negative value. Because there is no need to set the upper limit of MGamax at that time.

On the other hand, MGamax is set as the maximum actual charged intake air amount Gamax in the step S75 when the denominator (K2+Ne−Nemax) is a positive value and MGamax>Gamax. The reason are as follows:

(1) The target charged intake air amount MGa never exceeds the maximum actual charged intake air amount Gamax; And, (2) The intake air supply ratio SGa shown in the expression (13) never exceeds 1 (100%).

STEP S16

Figure 21:
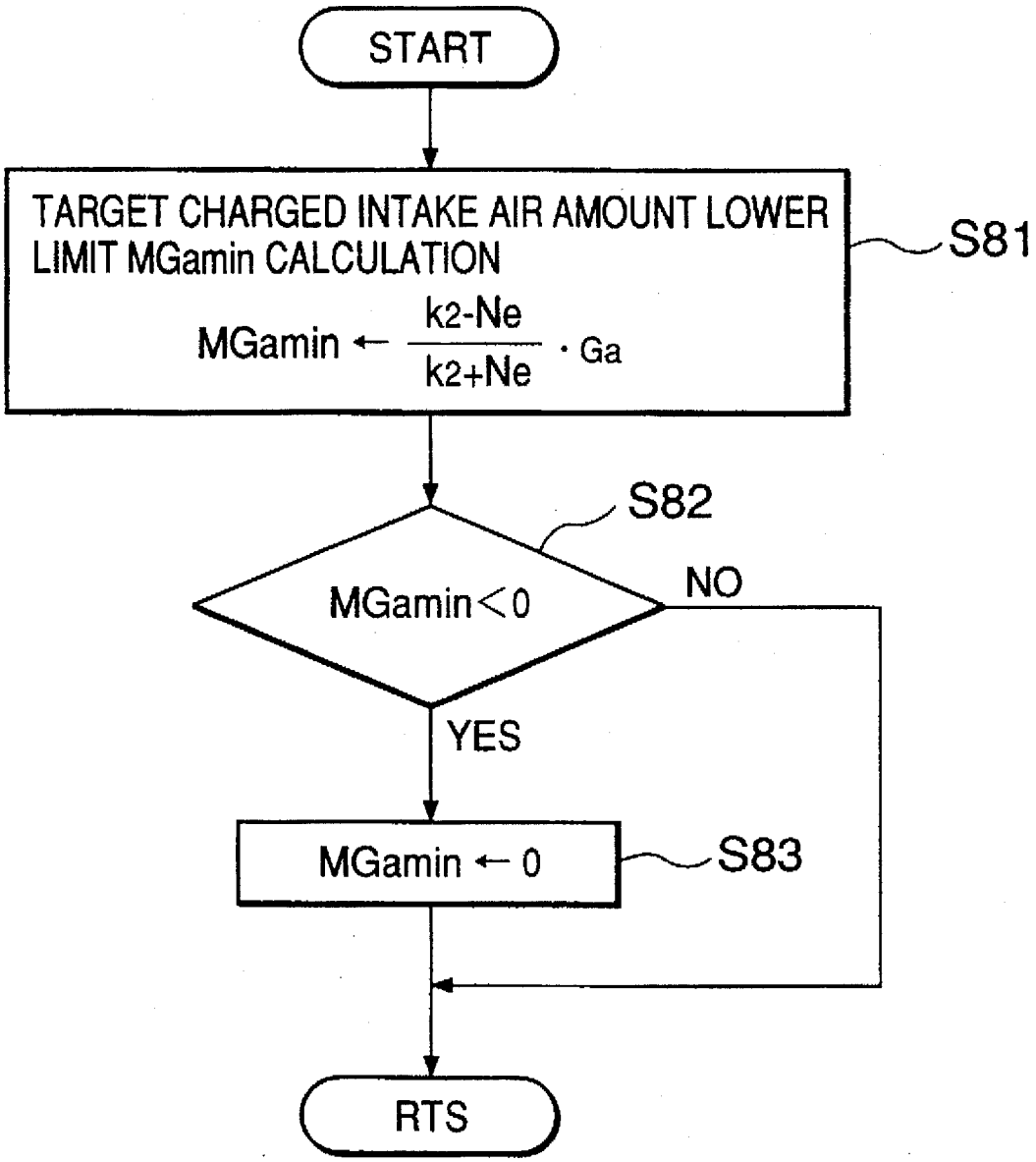
FIG. 21 is a flow chart of a target charged intake air amount lower limit value setting subroutine.

In STEP S16 shown in FIG. 14, a target charged intake air amount lower limit value setting subroutine is executed. The detail of this subroutine is shown in FIG. 21. This subroutine sets a lower limit value of the target charged intake air amount at which reverse calculation by the reverse chamber formula is of no use. By this process, the target engine speed indicating value MNe in the expression (13) is prevented from being a negative value due to a too small target charged intake air amount MGa. The lower limit value is set to prevent a throttle opening degree calculation being of no use when MGa becomes too small or an unreal negative value. This happens, for example, when the throttle valve 5a is rapidly closed in deceleration by releasing the accelerator pedal, and air remaining in the chamber provided downstream side of the throttle valve 5a is supplied to the cylinder.

In FIG. 21, the target charged air intake amount lower limit value Gamin is calculated by the following expression based on the actual charged intake air amount Ga and the engine speed Ne in step S81:

$$MGamin \leftarrow \{(K2-Ne)/(K2+Ne)\}.Ga$$

Next, in step S82, determination is made whether the target charged intake air amount limit value MGamin is a negative value or not. The subroutine goes to step S83 when it is negative (MGamin<0) to set MGamin to zero (MGamin←0) and the subroutine ends. On the other hand, when MGamin is zero or a positive value (MGamin≧0) in step S82, the subroutine ends immediately.

The target charged intake air amount limit value MGamin must satisfy the following expressions to make the engine speed indicating value MNe zero or a positive value in step S81:

$$Ne + \frac{60V \cdot (MGamin - Ga)}{D \cdot \Delta t \cdot (Ga + MGamin)} = 0$$

$$Ne \cdot D \cdot \Delta t \cdot (Ga + MGamin) = 60V \cdot (Ga - MGamin)$$

-continued $$MGamin = \frac{60V - Ne \cdot D \cdot \Delta t}{60V + Ne \cdot D \cdot \Delta t} \cdot Ga = \frac{\frac{60V}{D \cdot \Delta t} - Ne}{\frac{60V}{D \cdot \Delta t} + Ne} \cdot Ga = \frac{K2 - Ne}{K2 + Ne} \cdot Ga \quad (16)$$

When target charged intake air amount limit value MGamin becomes a negative value in step S82, MGamin is set to zero in step S83. Because the target charged intake air amount never becomes a negative value.

As described above, the upper and lower limit values MGamax and MGamin set in steps S15 and S16 make the target charged intake air amount MGa controllable. Therefore, as described later, an accurate air-fuel ratio control can be executed over entire driving range including a transitional period. This is because a fuel injection amount is set dependent on the target intake air amount MGa which is ultimately controllable over entire range.

STEP S17

Figure 22:
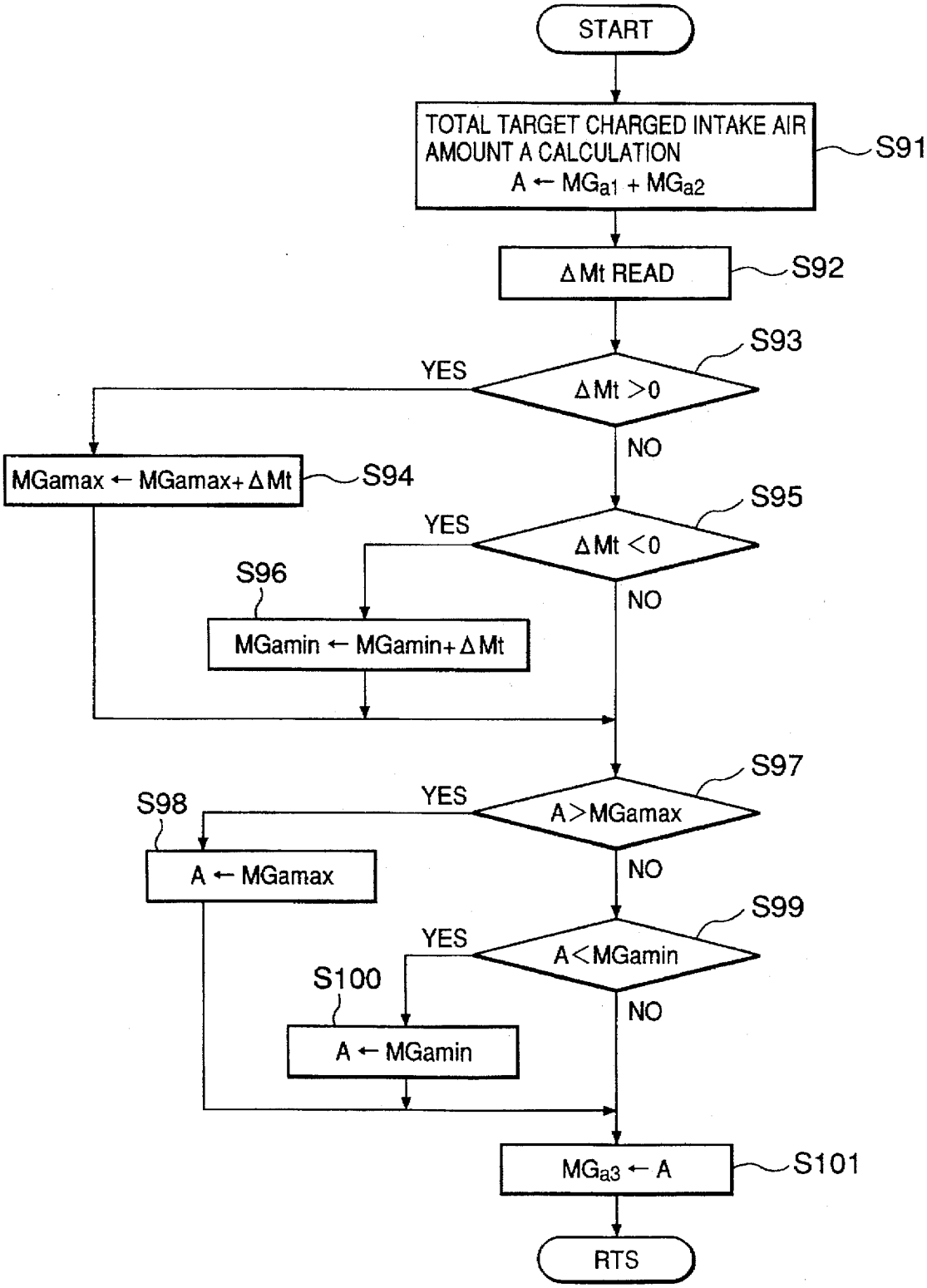
FIG. 22 is a flow chart of a target charged intake air amount setting subroutine for fuel amount calculation.

In STEP S17 shown in FIG. 14, a target charged air intake air amount setting subroutine is executed for fuel amount calculation. The detail of this subroutine is shown in FIG. 22. This subroutine sets a target charged intake air amount MGa3 for fuel calculation based on the total of the accelerator pedalling demand charged air intake air amount MGa1 and an idling demand charged intake air amount MGa2. Further, this subroutine sets MGa3 within the upper and lower limit values MGamax and MGamin set in STEPS S15 and S16.

In FIG. 22, the total target charged intake air amount A is calculated using the total of MGa1 and MGa2 (A←MGa1+MGa2) in step S91. The previously set air amount ΔMt corresponding to a delay due to fuel adhering to the inner wall of the intake port is red, in step S92.

Through steps S93 to S96, the target charged intake air amount upper and lower limit values MGamax and MGamin are made larger in response to the red amount ΔMt.

First, in step S93, determination is made whether ΔMt is a positive value. If positive (ΔMt>0), the subroutine goes to step S94, MGamax is updated using a value added by ΔMt (MGamax←MGamax+ΔMt). The subroutine then jumps to step S97. On the other hand, if ΔMt is a negative value or zero (ΔMt≦0) in step S94, the subroutine goes to step S95.

In step S95, determination is made whether ΔMt is a negative value. If negative (ΔMt<0), the subroutine goes to step S96, MGamin is updated using a value added by ΔMt (MGamin←MGamin+ΔMt). The subroutine then goes to step S97. On the other hand, if ΔMt is zero (ΔMt=0) in step S95, that is, there is no change in air amount Mt corresponding to fuel adhering to the inner wall of the intake port, the subroutine goes to step S97.

As discussed later and shown in FIG. 25, a target charged intake air amount MGa4 for the use of throttle opening degree setting is set by subtracting ΔMt from the target charged intake air amount MGa3 for fuel calculation.

It is therefore understood that response characteristics to a rapid torque demand is improved, and throttle opening degree control in the air intake system and fuel injection control in the fuel system are matched each other to achieve accurate fuel and air control by making larger the target charged intake air amount upper or lower limit values MGamax or MGamin by ΔMt.

Next, through steps S97 to S100 in FIG. 22, the total target charged intake air amount A calculated in step S91 is limited within the upper and lower limit values MGamax and MGamin.

First, in step S97, determination is made whether the amount A exceeds the upper limit value MGamax. If so (A>MGamax), the subroutine goes to step S98, the amount A is set using MGamax (A←MGamax). The subroutine then jumps to S101. On the other hand, if the amount A is equal to MGamax or smaller (A≦MGamax) in step S97, the subroutine goes to step S99.

In step S99, determination is made whether the amount A is smaller than the lower limit value MGamin. If so (A<MGamin), the subroutine goes to step S100, the amount A is set using MGamin (A←MGamin). The subroutine then goes to S101.

On the other hand, if the amount A is within MGamax and MGamin (MGamax≧A≧MGamin in steps S97 and S99), the subroutine goes to step S101.

In step S101, the target charged intake air amount MGa3 is set using the amount A, and the subroutine ends.

STEP S18

Figure 23:
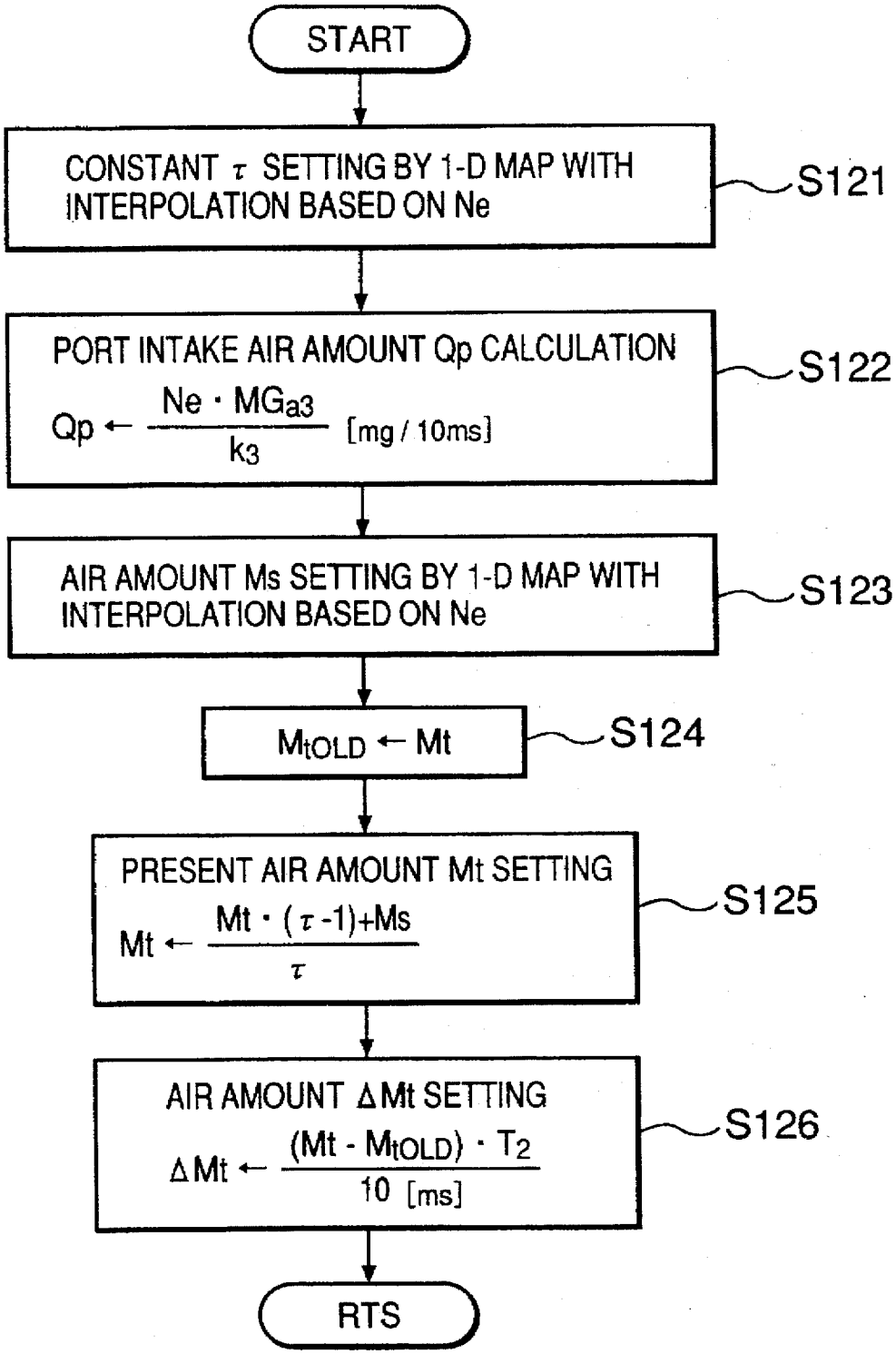
FIG. 23 is a flow chart of an intake air amount setting subroutine, the amount corresponding to a delay due to fuel adhering.

In STEP S18 shown in FIG. 14, an air amount (corresponding to delay due to fuel adhering to the inner wall of the intake port) setting subroutine is executed. The detail of this subroutine is shown in FIG. 23. This subroutine obtains an accurate air-fuel ratio by adjusting the intake air in the intake system to the fuel adhering (FIG. 10.) The adjustment is made to compensate for a delay in supplying fuel to the cylinder due to the state that a part of the fuel injected by the injector 23 is adhered to the inner wall of the intake port.

Figure 24A:
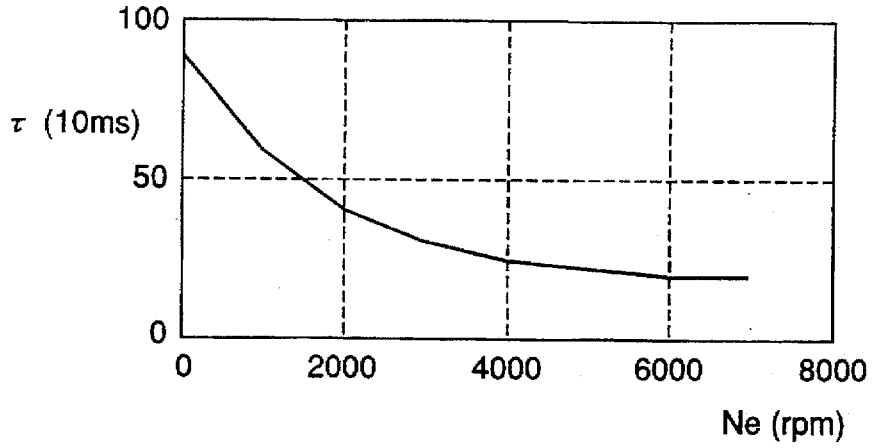
FIGS. 24A and 24B are graphs explaining one dimensional maps for setting a primary delay constant with respect to the delay due to fuel adhering and an air amount corresponding to a fuel adhering in a steady state, respectively.

In step S121 in FIG. 23, one dimensional map is referred to with interpolation calculation based on the engine speed Ne to set a primary delay time constant τ. Suppose that a constant fuel adhering amount Mx to the intake port is known for each driving range. Further, suppose that a transitional fuel adhering amount Mt changes with a primary delay when the driving range changes. In this case, a primary delay time constant τ is decided per engine driving range. As shown in FIG. 24A, the one dimensional map stores primary delay time constants τ that become shorter as the engine speeds Ne become higher. Because flow rate of intake air passing through the intake port becomes rapid as engine speeds Ne become higher.

Next, in step S122 in FIG. 23, a port intake air flow amount Qp per intake port is calculated by the following expression based on the engine speed Ne and the target charged intake air amount MGa3:

$$Qp \leftarrow (Ne \cdot MGa3)/K3 \text{ [mg/10 ms]} \quad (17)$$

where K3 is a constant that depends on a type of an engine. In the case of a 4 cycle—4 cylinder engine, K=2·60·100 because a calculation interval is 10 ms. The port intake air flow amount Qp may be constant at high load and high engine speed range, such as 6000 rpm or more. Because the fuel adhering often occurs at low load and low engine speed range.

Figure 24B:
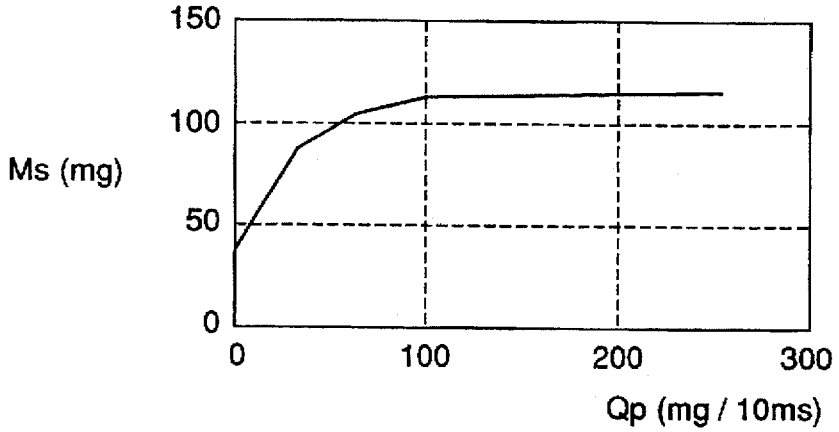

Next, in step S123 in FIG. 23, an air amount Ms corresponding to a constant fuel adhering is set by referring to one dimensional map with interpolation calculation based on the port intake air flow amount Qp. The air amount Ms is set by multiplying a constant fuel adhering amount Mx by a target air-fuel ratio, such as 14.6, a theoretical air-fuel ratio. As shown in FIG. 24B, the air amount Ms gradually becomes small as the air flow amount Qp increases, or as the engine driving range is shifted to a high load and high engine speed range.

After that, in step S124, the air amount Mt corresponding to a transitional fuel adhering amount set in the previous calculation cycle is set as a previous air amount MtOLD.

Then, in step S125, an air amount Ms corresponding to a constant fuel adhering amount in a present driving range and the previous air amount MtOLD are processed by the following expression to calculate a present air amount Mt corresponding to the transitional fuel adhering.

$$Mt \leftarrow \{Mt.(\tau-1)+Ms\}/\tau$$

Next, in step S126, based on MtOLD and Mr, an air amount ΔMt corresponding to the fuel adhering per cycle of one cylinder is calculated by the following expression:

$$\Delta Mt \leftarrow (Mt-MtOLD).T2/10 \text{ [ms]}$$

where T2 denotes a period required for one cycle of one cylinder, or a period of 2 rotations.

As described above, air intake operation is delayed to match a delay due to the fuel adhering to the intake port which is assumed by the fuel adhering model formula. Accordingly, the present invention obtains an air-fuel ratio stable to transitional torque changes and improves transitional torque characteristics and exhaust emission though response of control becomes little bit worse.

As discussed above, this invention utilizes the fuel adhering model formula as the forward formula in the air intake system. Therefore, an adhering fuel amount that flows into the cylinder becomes larger than an adequate amount with respect to the intake air amount during rapid change in load to low from high at which large amount of fuel adheres to the intake port wall even if the fuel injection amount is set to zero.

In this case, the conventional fuel adhering reverse model cannot prevent the air-fuel ratio from being over-rich because it cancels the fuel adhering by adding a fuel amount corresponding to the fuel adhering to a fuel injection amount. The fuel injection is thus set to zero only as the minimum value.

On the other hand, the present invention compensates for the fuel adhering delay in the air intake system. An intake air amount is thus set to match the fuel amount that adheres to the intake port wall and then flows into the cylinder. This results in an accurate air-fuel ratio control even in a transitional period.

STEP S19

Next, in STEP S19 shown in FIG. 14, a target charged intake air amount setting subroutine for throttle opening degree setting is executed. The detail of this subroutine is shown in FIG. 25. This subroutine calculates a target charged intake air amount MGa4 for throttle opening degree setting. The amount MGa4 is an intake air amount corresponding to a fuel amount that flows into the cylinder.

Figure 25:
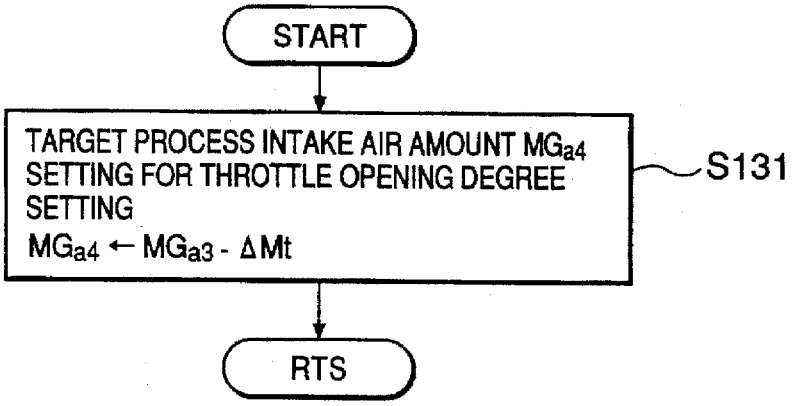
FIG. 25 is a flow chart of a target charged intake air amount setting subroutine for throttle opening degree setting.

In step S131 of FIG. 25, an intake air amount ΔMt corresponding to the fuel adhering is subtracted from the target charged intake air amount MGa3 for fuel amount calculation. By the subtraction, the amount MGa4 as a target charged intake air amount corresponding to a fuel amount that flows into the cylinder after a time Δt is calculated (MGa4←MGa3−ΔMt), and the subroutine ends.

This subroutine explains that: a fuel injection amount increases according to an acceleration demand, etc., due to increase in pedalling amount θacc of the accelerator pedal when ΔMt is a positive value (ΔMt>0); the present fuel adhering amount thus increases with respect to the previously calculated adhering amount (10 ms before); and, thus, a fuel amount actually supplied to the cylinder is smaller than the fuel injection amount by the injector 23. Therefore, the subroutine in FIG. 25 calculates MGa4 by subtracting ΔMt from MGa3 to set a throttle opening degree to obtain an intake air amount that matches a fuel amount supplied to the cylinder. This results in an air-fuel ratio adequate to a target transitional air-fuel ratio and high air-fuel ratio controllability.

Further, when ΔMt is a positive value, ΔMt makes larger the target charged intake air amount upper limit value MGamax. This results in the upper limit being prevented from being made unnecessarily smaller according to ΔMt. Therefore, the MGa4 that is an indicating value for throttle opening degree setting can be set to the extent of allowable upper limit.

On the other hand, when the throttle valve 5*a* is rapidly closed due to decrease in pedalling amount θacc of the accelerator pedal, the intake air amount ΔMt corresponding to the fuel adhering becomes a negative value (ΔMt<0). In this case a negative intake air pressure peels off the fuel adhered to the intake port wall. Thus, the present fuel adhering amount decreases compared to the previously calculated fuel adhering amount (10 ms before). This means that a fuel amount supplied to the cylinder is larger than that injected by the injector 23. By subtracting ΔMt (negative value) from the target charged intake air amount MGa3 for fuel amount calculation, the target charged intake air amount MGa4 for throttle opening degree setting increases by ΔMt with respect to MGa3. Thus, a throttle opening degree can be set for obtaining intake air amount that matches a fuel amount supplied to the cylinder in deceleration. This results in an air-fuel ratio adequate to a target transitional air-fuel ratio and high air-fuel ratio controllability.

Further, when ΔMt is a negative value, ΔMt makes larger the target charged intake air amount lower limit value MGamax. This results .in the lower limit being prevented from being made unnecessarily larger according to ΔMt. Therefore, the MGa4 that is an indicating value for throttle opening degree setting can be set to the extent of the lower limit.

The intake air amount ΔMt corresponding to a delay due to the fuel adhering increases (or decreases) when fuel decreases (or increases) depending on the change in target charged intake air amount MGa3 for fuel calculation. Thus the range of change in target charged intake air amount MGa4 for throttle opening degree setting becomes smaller than that of MGa3. Therefore, in step S131 of FIG. 25, MGa4 does not overflow or underflow. There is thus no need to provide upper and lower limits in calculation of MGa4 by subtracting ΔMt from MGa3.

STEP S20

Figure 26:
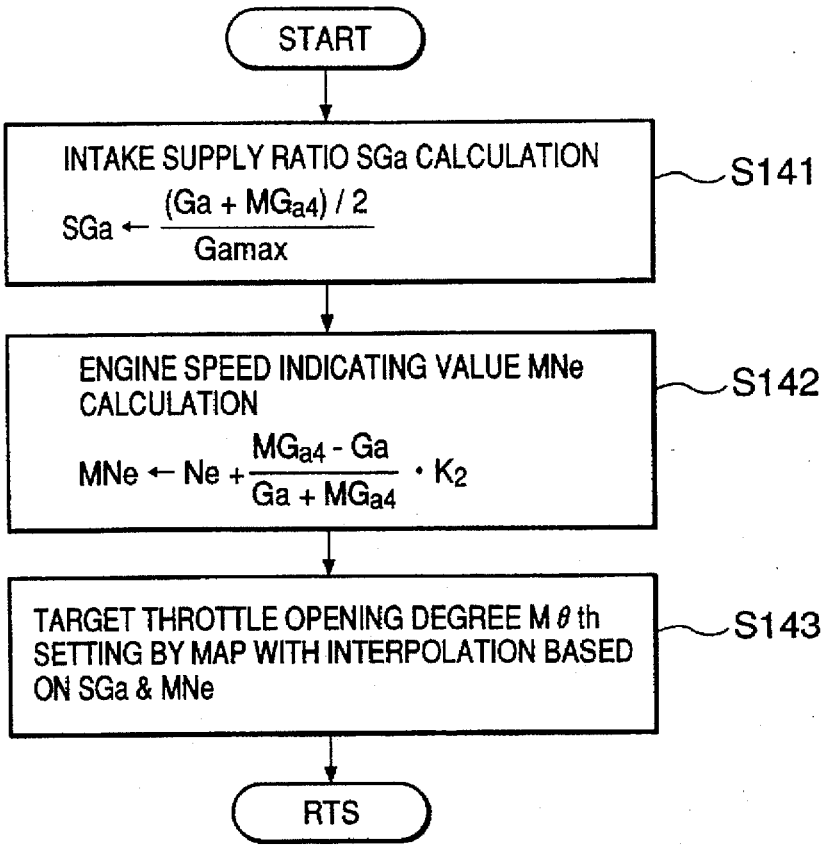
FIG. 26 is a flow chart of a target throttle opening degree setting subroutine.

Next, in STEP S20 shown in FIG. 14, a target throttle opening degree setting subroutine is executed. The detail of this routine is shown in FIG. 26. This subroutine sets a target throttle opening degree Mθth by referring to a throttle opening degree map with interpolation calculation based on the intake air supply ratio SGa and engine speed indicating value MNe both shown in the expression (13).

First, in step S141 of FIG. 26, SGa is calculated by the following expression:

$$SGa \leftarrow \{(Ga+MGa4)/2\}/Gamax \quad (13\text{-}1)$$

next, in step S142, MNe is calculated by the following expression:

$$MNe \leftarrow Ne+\{(MGa4-Ga)/(Ga+MGa4)\}.K2 \quad (13\text{-}2)$$

where K2=60V/(D.Δt).

Figure 27:
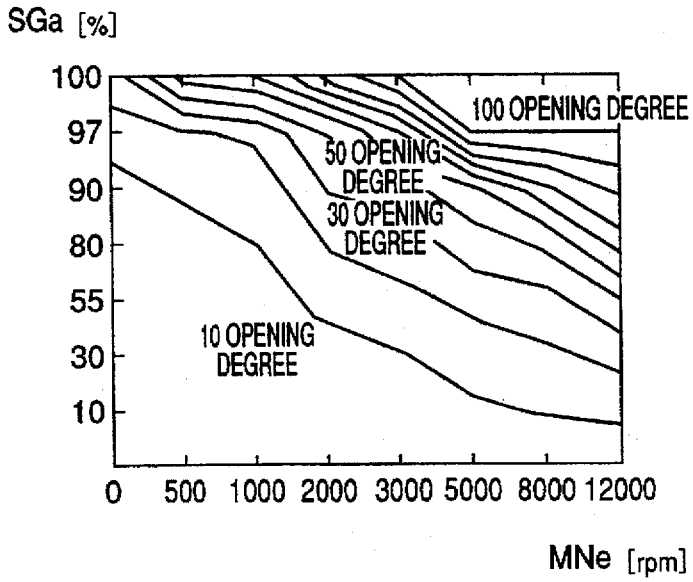
FIG. 27 is a graph explaining a throttle opening degree map.

Further, in step S143, Mθth is set by referring to the throttle opening degree map shown in FIG. 27 with interpolation calculation based on SGa and MNe, and the subroutine ends.

As discussed above, Math can be set even in the steady state by referring to the throttle opening degree map. Because the actual charged intake air amount Ga and the target charged intake air amount MGa4 for throttle opening degree setting become equal to each other in the steady state.

An intake air ratio SGa in the steady period is obtained by the following expression:

$$SGa=MGa4/Gamax \quad (13\text{-}1')$$

and, the engine speed indicating value MNe is $$MNe=Ne. \quad (13\text{-}2')$$

The ratio SGa of MGa4 to MGamax is calculated to normalize MGa4 (SGa=MGa/Gamax). Based on SGa and Ne, MΘth is set by referring to the throttle opening degree map with interpolation calculation. And, based on MΘth, a throttle actuator driving amount Dact is set as a throttle opening degree control amount for the throttle actuator 20.

Therefore, there is no need to compose an additional throttle opening degree map for a transitional state. As shown in FIG. 27, the throttle opening degree map made of un-equivalent lattices in the steady state is utilized to set MΘth by only changing SGa and MNe even in the transitional state.

In the driving range where the intake air ratio SGa and engine speed Ne are large, the target throttle opening degree MΘth varies greatly with slight change in SGa and Ne. Thus, as shown in FIG. 27, the throttle opening degree map is composed so as to correspond to such change in MΘth. More in detail, the lattices of SGa and MNe are made of unequivalent intervals. Further, the intervals are made larger in the driving range where SGa and MNe are both large to accurately set MΘth in accordance with SGa. Further, based on MΘth thus set, the throttle actuator driving amount Dact is accurately set to improve throttle opening degree controllability.

In the invention, the air flow amount of wide dynamic range passing through a throttle valve is not directly obtained in setting MΘth. Rather, the target throttle opening degree MΘth both in steady and transitional states are set using the map based on the actual charged intake air amount Ga per cycle of one cylinder, the target charged intake air amount MGa4 for throttle opening setting and the engine speed Ne.

The dynamic range of each charged intake air amount thus becomes 1/10 or less with respect to the air flow amount Qth that passes the throttle valve. Further, the dynamic range of engine speed Ne while driving is in the range of idling to the maximum engine speed and extremely narrow with respect to Qth.

Therefore, in the present invention, the dynamic ranges of variables used in setting the throttle actuator driving amount Dact as the throttle opening degree control amount are narrow. This results in accurate throttle opening degree control in the entire driving ranges without heavy load to the computer.

Further, a self-restoration function of a throttle opening degree error is achieved by calculating the engine speed indicating value MNe by the expression (13-2). That is, there is a case where the value MNe is set smaller than an actual engine speed Ne according to the expression (13-2). This happens when there is a throttle opening degree error and the actual charged intake air amount Ga is not equal to the target charged intake air amount MGa4 for throttle opening degree setting, for example, Ga is larger than MGa4.

The throttle opening degree map in the steady state stores the target throttle opening degrees MΘth being smaller as the engine speed indicating values MNe become smaller when Ga is constant. The throttle opening degree Θth is thus controlled in the direction of closing when the throttle opening degree map is referred to based on MNe. This results in Ga being adjusted to a small value to follow MGa4. When Ga is smaller than MGa4, Θth is controlled in the direction of opening to follow MGa4.

More in detail, the constant K2 in the expression (13-2) is K2=60V/(D.Δt). Thus, K2=24000 [rpm] when V/D=4 and Δt=1/100 [sec]. An ordinary engine deviates about 120 [rpm] to refer to the throttle opening degree map when there is 1% deviation between Ga and MGa4. And, the lower the engine speed, the larger the throttle opening degree at 120 [rpm] deviation due to the characteristics of the throttle opening degree map. Therefore, the lower the engine speed at which a throttle opening degree error easily arises, the stronger the self-restoration with respect to the throttle opening degree error. In this case, the constant K2 (=24000[rpm]) can be considered as the error feedback gain in throttle opening degree control.

STEP S21

Figure 28:
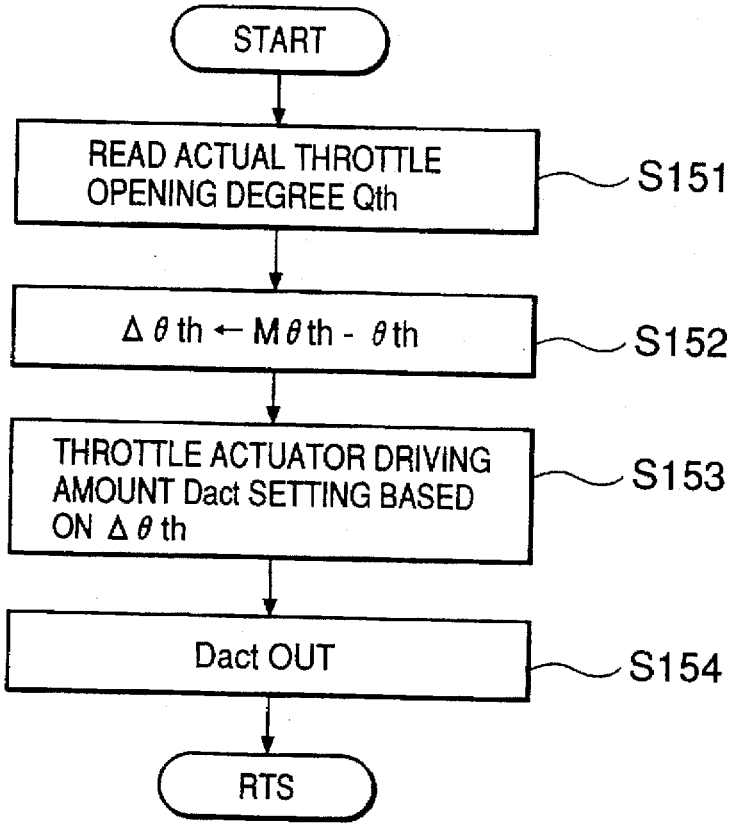
FIG. 28 is a flow chart of a throttle actuator driving amount setting subroutine.

Next, in STEP S21 shown in FIG. 14, a throttle actuator driving amount setting subroutine. The detail of this subroutine is shown in FIG. 28. First, in step S151 of FIG. 28, an actual opening degree Θth is read that is detected based on an output value of the throttle opening degree sensor 32. In step S152, Θth is subtracted from the target throttle opening degree MΘth to calculate a throttle opening degree difference ΔΘth (=MΘth−Θth).

Further, in step S153, a throttle actuator driving amount Dact is set by referring to one dimensional map with interpolation operation or calculating based on ΔΘth. Next, in step S154, the amount Dact is applied to the throttle actuator 20 connected to the throttle valve 5*a*, and the subroutine ends. The opening degree of the throttle valve 5*a* is so controlled that the actual charged intake air amount Ga follows the target charged intake air amount MGa4 for throttle opening degree setting.

Figure 29:
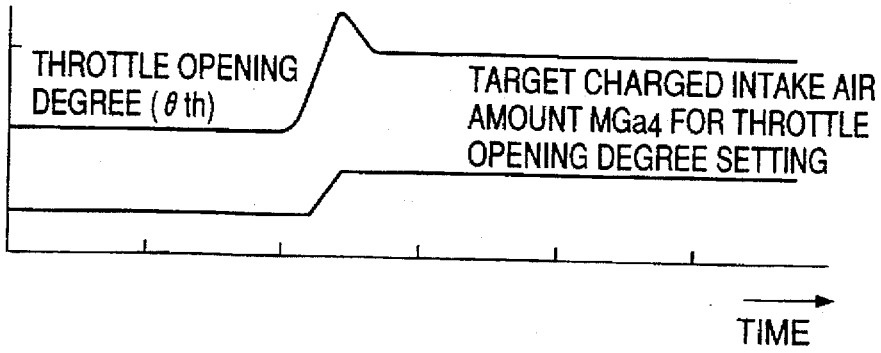
FIG. 29 is a graph explaining a relationship between the throttle opening degree and the target charged intake air amount for throttle opening degree setting.

As shown in FIG. 29, to vary MGa4 step-wise in a transitional state where the driving range changes, the throttle opening degree is changed to overshoots due to charging air in the chamber. To change the throttle opening degree so quickly, high throttle valve opening degree controllability is secured. This can be achieved by the subroutine shown in FIG. 28 with a high speed throttle actuator 20 by which the actual charged intake air amount Ga quickly follows the target charged intake air amount MGa4.

Next, fuel system control will be explained with reference to FIGS. 30 and 31. As shown in FIG. 10, there is a delay in the fuel system due to fuel adhering to the intake port wall. However, this delay is cancelled by synchronization in the air intake system. Thus, in the fuel injection amount setting routine, a fuel injection amount that matches a target air-fuel ratio is set based on the target charged intake air amount MGa3 for fuel calculation. The fuel injection amount setting routine is executed per 10 msec.

Figure 30:
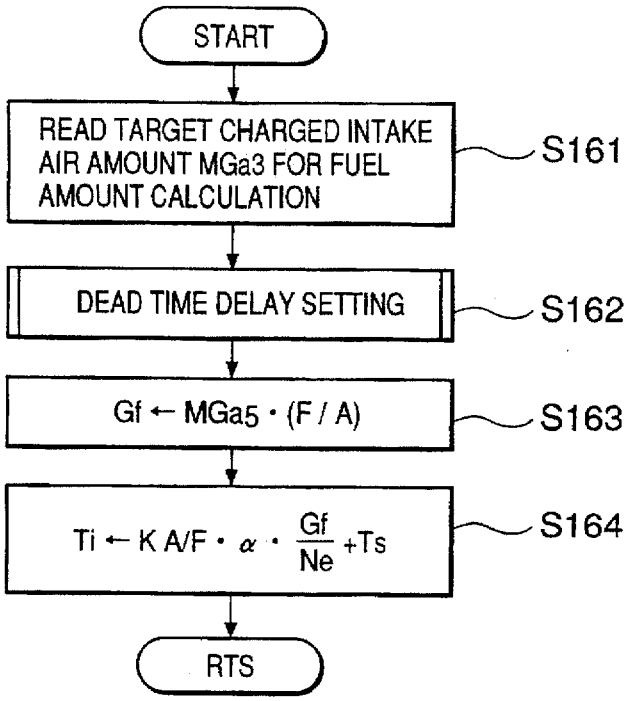
FIG. 30 is a flow chart of a fuel injection amount setting routine.
Figure 31:
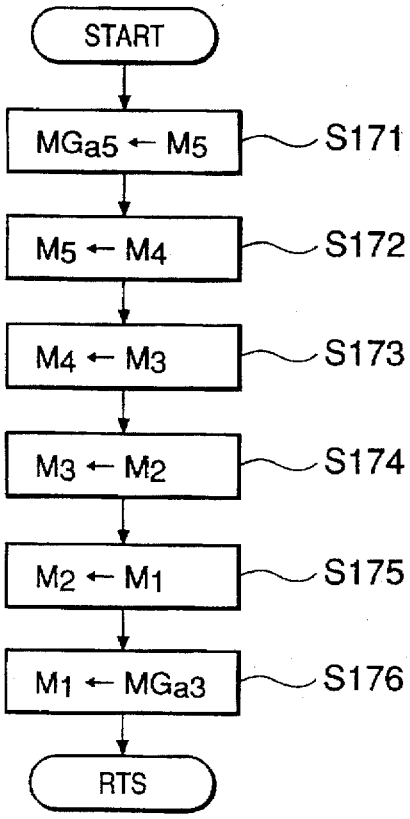
FIG. 31 is a flow chart of a dead time setting routine.

In step S161 of FIG. 30, MGa3 is read, and in step S162, a dead time setting subroutine is executed as shown in FIG. 31. The subroutine synchronizes the fuel system with a delay that arises in the throttle actuator 20 of the air intake system. Rich or lean spike of air-fuel ratio in the transitional state is thus prevented that would occur due to delay that arises in the motion of the throttle actuator 20.

As shown in FIG. 31, target charged intake air amounts MGa3 stored in registers M1 to M5 are shifted in steps S171 to S175.

First, in step S171, a target charged intake air amount MGa3 for fuel injection amount setting set 50 msec before and stored in the register M5 is set as the present target charged intake air amount MGa5 for fuel injection amount setting. In step S172, an intake air amount stored in the register M4 is shifted to the register M5, the same operation being executed over the steps S173 to S175. In step S176, MGa3 now read is stored in the register M1, and the subroutine ends.

Then, the process moves onto step S163 of FIG. 30, to set a fuel injection amount Gf based on MGa5 with dead time processing and the target air-fuel ratio F/A {Gf←MGa5.(F/A)}. Next, in step S164, a fuel injection pulse width Ti equivalent to a fuel injection amount of the injector 23 is set based on the following expression:

$$Ti \leftarrow K_{A/F}.\alpha.Gf/Ne+Ts$$

where $K_{A/F}$ is an injector characteristics compensation constant, $\alpha$ is an air-fuel ratio feedback compensation constant and Ts is a voltage compensation pulse width for compensating a null injection time of the injector 23 based on a terminal voltage VB of the battery 57. And, the subroutine ends.

As described above, in the fuel system, the fuel injection pulse width Ti is set based on the target charged intake air amount MGa5 for fuel amount calculation obtained by a demand torque, not by the actual charged intake air amount Ga. And, in the air intake system, the target charged intake air amount MGa4 is set to have a desired air-fuel ratio based on a fuel amount flowing to the cylinder. Thus, a throttle opening degree is set at which Ga follows MGa4. That is, a fuel amount is primarily controlled in the entire driving range.

Therefore, since a fuel injection amount can be set based on a demand torque without respect to an air flow amount that passes the throttle valve, even if it does not work, an accident, such as, rapid acceleration, can be avoided.

Further, a fuel amount and a throttle opening degree to obtain a charged intake air amount suitable for the fuel amounts to have a preset air-fuel ratio are set at the same time. This achieves high air-fuel ratio controllability even in the transitional state.

The embodiment employs the accelerator pedalling amount θacc as the driver's demand output. Not limited to this, however, this invention can employ an operational amount of throttle lever as the drivers' demand output when engine output is changed by manually operating the throttle lever.

Further, this invention can be applied to automatic driving control by operating an accelerator with an electric control apparatus including a microcomputer. In this case, "driver" described above includes a human being and also the control apparatus.

As disclosed above, the present invention employs a charged intake air amount sucked into one cylinder per intake stroke. A target charged intake air amount is set based on a driver's demand output. Further, the maximum actual charged intake air amount at the full throttle is set based on an intake pipe pressure at an upstream side of the throttle valve. A ratio of the target charged intake air amount to the maximum actual charged intake air amount is calculated to normalize the target charged intake air amount. Based on an engine speed and the normalized target charged intake air amount, a throttle opening degree control value is set for a throttle actuator connected to the throttle valve. In the invention, variables used for setting the throttle opening degree are of narrow dynamic range. This results in a low calculation load compared to conventional techniques using an intake air flow amount as a variable of wide dynamic range.

Therefore, a conventional computer can be used in the engine control apparatus of the invention to accurately set a throttle opening degree corresponding to the target intake air amount.

Further, an accelerator pedalling amount is used as a demand output. Thus, the invention is applicable to control of a vehicle engine.

Further, a throttle opening degree control value for a throttle actuator is set by referring to a map having unequivalent interval lattices of the normalized target charged intake air amount and the engine speed. Therefore, change in throttle opening degree is appropriately controlled depending on parameters.

Thus, the throttle opening degree control value for the throttle actuator can be accurately set to have high throttle opening degree controllability.

What is claimed is:

1. A control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising:

means, responsive to the demand output, for setting a target charged intake air amount of air taken into the cylinder per intake stroke;

means, based on an air pressure generated at an upstream side of the throttle valve, for setting the maximum actual charged intake air amount as the maximum value of an actual charged intake air amount taken into the cylinder per intake stroke;

means for normalizing the target charged intake air amount by calculating a ratio of the target charged intake air amount to the maximum actual charged intake air amount;

means for setting the throttle valve opening degree based on the normalized target charged intake air amount and an engine speed; and means for outputting a signal for actuating the throttle valve to the throttle actuator so that the throttle valve has the opening degree set by the throttle valve opening degree setting means.

2. An apparatus according to claim 1, further comprising:

means for setting a fuel injection amount based on the target charged intake air amount; and means for driving the injector so that the fuel injection amount set by the fuel injection amount setting means is supplied to the engine.

3. An apparatus according to claim 2, further comprising means for setting an air amount corresponding to a delay due to fuel adhering to an inner-wall of an intake port of the engine during one cycle of the cylinder by means of a fuel adhering delay compensating model based on the engine speed and the target charged intake air amount, thus compensating for the target charged intake air amount using the air amount corresponding to the delay.

4. An apparatus according to claim 2, further comprising:

means for setting an actual charged intake air amount taken into the cylinder per intake stroke based on an intake port air pressure generated at a downstream side of the throttle valve:; and means for limiting the target charged intake air amount so that the target charged intake air amount does not increase more than an upper limiting value set based on the actual charged intake air amount, the engine speed and a predetermined maximum engine speed.

5. An apparatus according to claim 3, further comprising:

means for setting an actual charged intake air amount taken into the cylinder per intake stroke based on an intake port air pressure generated at a downstream side of the throttle valve:; and means for limiting the target charged intake air amount so that the target charged intake air amount does not increase more than an upper limiting value set based on the actual charged intake air amount, the engine speed and a predetermined maximum engine speed, wherein the air amount corresponding to the delay is added to the upper limiting value when the air amount corresponding to the delay is a positive value.

6. An apparatus according to claim 2, further comprising:

means for setting an actual charged intake air amount taken into the cylinder per intake stroke based on an air pressure generated at a downstream side of the throttle valve:; and means for limiting the target charged intake air amount so that the target charged intake air amount does not decrease less than a lower limiting value set based on the actual charged intake air amount and the engine speed.

7. An apparatus according to claim 3, further comprising:

means for setting an actual charged intake air amount taken into the cylinder per intake stroke based on an intake port air pressure generated at a downstream side of the throttle valve:; and means for limiting the target charged intake air amount so that the target charged intake air amount does not decrease less than a lower limiting value set based on the actual charged intake air amount and engine speed, wherein the air amount corresponding to the delay is added to the lower limiting value when the air amount corresponding to the delay is a negative value.

8. An apparatus according to claim 2, further comprising means for executing a dead time process, the dead time being corresponding to a delay in actuating the throttle valve by the actuator in response to the target charged intake air amount.

9. A control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising:

means, responsive to the demand output, for setting a target charged intake air amount of air taken into the cylinder per intake stroke;

means, based on an air pressure generated at a downstream side of the throttle valve, for setting an actual charged intake air amount taken into the cylinder per intake stroke;

means, responsive at least to the target and actual charged intake air amounts, for calculating, using a reverse chamber model, a throttle valve opening degree required for equalizing the target charged intake air amount and an actual charged intake air amount taken into the cylinder after an elapse of a minute period; and means for outputting a signal for actuating the throttle valve to the throttle actuator so that the throttle valve has the calculated opening degree.

10. An apparatus according to claim 9, further comprising:

means for setting a fuel injection amount based on the target charged intake air amount; and means for driving the injector so that the fuel injection amount set by the fuel injection amount setting means is supplied to the engine.

11. An apparatus according to claim 10, further comprising means for setting an air amount corresponding to a delay due to fuel adhering to an inner-wall of an intake port of the engine during one cycle of the cylinder by means of a fuel adhering delay compensating model based on the engine speed and the target charged intake air amount, thus compensating for the target charged intake air amount using the air amount corresponding to the delay.

12. An apparatus according to claim 10, further comprising means for limiting the target charged intake air amount so that the target charged intake air amount does not increase more than an upper limiting value set based on the actual charged intake air amount, the engine speed and a predetermined maximum engine speed.

13. An apparatus according to claim 11, further comprising means for limiting the target charged intake air amount so that the target charged intake air amount does not increase more than an upper limiting value set based on the actual charged intake air amount, the engine speed and a predetermined maximum engine speed, wherein the air amount corresponding to the delay is added to the upper limiting value when the air amount corresponding to the delay is a positive value.

14. An apparatus according to claim 10, further comprising means for limiting the target charged intake air amount so that the target charged intake air amount does not decrease less than a lower limiting value set based on the actual charged intake air amount and the engine speed.

15. An apparatus according to claim 11, further comprising means for limiting the target charged intake air amount so that the target charged intake air amount does not decrease less than a lower limiting value set based on the actual charged intake air amount and engine speed, wherein the air amount corresponding to the delay is added to the lower limiting value when the air amount corresponding to the delay is a negative value.

16. An apparatus according to claim 10, further comprising means for executing a dead time process, the dead time being corresponding to a delay in actuating the throttle valve by the actuator in response to the target charged intake air amount.

17. A control apparatus of an engine for controlling a throttle valve opening degree in response to a demand output of a driver, the engine having at least one cylinder, an intake pipe connected to the cylinder, a throttle valve disposed in the intake pipe, a throttle actuator for actuating the throttle valve and an injector for supplying fuel to the engine, the apparatus comprising:

means, responsive to the demand output, for setting a target charged intake air amount of air taken into the cylinder per intake stroke;

means, based on an air pressure generated at a downstream side of the throttle valve, for setting an actual charged intake air amount taken into the cylinder per intake stroke;

means, based on an air pressure generated at an upstream side of the throttle valve, for setting the maximum charged intake air amount as the maximum value of an actual charged intake air amount taken into the cylinder per intake stroke;

means for setting the throttle valve opening degree based on an intake air ratio and an engine speed indicating value, the intake air ratio being a ratio of a mean value of the target charged intake air amount and the actual charged intake air amount to the maximum charged intake air amount, the engine speed indicating value being calculated by adding an engine speed and an increment or a decrement of the engine speed based on the target charged intake air amount and the actual charged intake air amount; and means for outputting a signal for actuating the throttle valve to the throttle actuator so that the throttle valve has the opening degree set by the throttle valve opening degree setting means.

18. An apparatus according to claim 17, further comprising:

means for setting a fuel injection amount based on the target charged intake air amount; and means for driving the injector so that the fuel injection amount set by the fuel injection amount setting means is supplied to the engine.

19. An apparatus according to claim 18, further comprising means for setting an air amount corresponding to a delay due to fuel adhering to an inner-wall of an intake port of the engine during one cycle of the cylinder by means of a fuel adhering delay compensating model based on the engine speed and the target charged intake air amount, thus compensating for the target charged intake air amount using the air amount corresponding to the delay.

20. An apparatus according to claim 18, further comprising means for limiting the target charged intake air amount so that the target charged intake air amount does not increase more than an upper limiting value set based on the actual charged intake air amount, the engine speed and a predetermined maximum engine speed.

21. An apparatus according to claim 19, further comprising means for limiting the target charged intake air amount so that the target charged intake air amount does not increase more than an upper limiting value set based on the actual charged intake air amount, the engine speed and a predetermined maximum engine speed, wherein the air amount corresponding to the delay is added to the upper limiting value when the air amount corresponding to the delay is a positive value.

22. An apparatus according to claim 18, further comprising means for limiting the target charged intake air amount so that the target charged intake air amount does not decrease less than a lower limiting value set based on the actual charged intake air amount and the engine speed.

23. An apparatus according to claim 19, further comprising means for limiting the target charged intake air amount so that the target charged intake air amount does not decrease less than a lower limiting value set based on the actual charged intake air amount and engine speed, wherein the air amount corresponding to the delay is added to the lower limiting value when the air amount corresponding to the delay is a negative value.

24. An apparatus according to claim 18, further comprising means for executing a dead time process, the dead time being corresponding to a delay in actuating the throttle valve by the actuator in response to the target charged intake air amount.

* * * * *